US011190892B2

(12) United States Patent
Mathur

(10) Patent No.: US 11,190,892 B2
(45) Date of Patent: Nov. 30, 2021

(54) AUDIO SAMPLE PHASE ALIGNMENT IN AN ARTIFICIAL REALITY SYSTEM

(71) Applicant: Facebook Technologies, LLC, Menlo Park, CA (US)

(72) Inventor: Alok Kumar Mathur, Cupertino, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/738,247

(22) Filed: Jan. 9, 2020

(65) Prior Publication Data

US 2021/0152966 A1 May 20, 2021

Related U.S. Application Data

(60) Provisional application No. 62/938,114, filed on Nov. 20, 2019.

(51) Int. Cl.
*H04R 29/00* (2006.01)
*H04R 3/00* (2006.01)
*H04R 1/40* (2006.01)

(52) U.S. Cl.
CPC ..... *H04R 29/005* (2013.01); *H04R 1/406* (2013.01); *H04R 3/005* (2013.01)

(58) Field of Classification Search
CPC ..... H04R 29/005; H04R 1/406; H04R 3/005
See application file for complete search history.

(56) References Cited

U.S. PATENT DOCUMENTS 7,711,443 B1 5/2010 Sanders et al.
9,111,548 B2 8/2015 Nandy et al.
2005/0169483 A1* 8/2005 Malvar ..... H04R 3/005 381/58
2005/0244018 A1* 11/2005 Fischer ..... H04R 29/006 381/92
2010/0111329 A1* 5/2010 Namba ..... H04R 3/005 381/119
2015/0112671 A1* 4/2015 Johnston ..... H04R 1/1083 704/233
2015/0213811 A1* 7/2015 Elko ..... H04R 25/453 381/92

(Continued)

FOREIGN PATENT DOCUMENTS

WO 2012/061151 A1 5/2012

OTHER PUBLICATIONS

U.S. Appl. No. 16/506,618, filed Jul. 9, 2019, by Atlas et al.

(Continued)

*Primary Examiner* — Simon King

(74) *Attorney, Agent, or Firm* — Shumaker & Sieffert, P.A

(57) ABSTRACT

This disclosure describes techniques that include aligning processing of audio samples collected by multiple audio sensors or microphones. In one example, this disclosure describes a method comprising enabling a first microphone; processing, by an audio processor and using a first processing pipeline, audio data samples collected by the first microphone; enabling a second microphone a period of time after enabling the first microphone; processing, by the audio processor and using a second processing pipeline, a sample of audio data collected by the second microphone by synchronizing starting times for the first and second processing pipelines.

19 Claims, 15 Drawing Sheets

(56) References Cited

U.S. PATENT DOCUMENTS

| | | | | |
|---|---|---|---|---|
| 2016/0134966 | A1 | 5/2016 | Fitzgerald et al. | |
| 2019/0289393 | A1* | 9/2019 | Amarilio | H04R 3/12 |
| 2019/0335287 | A1* | 10/2019 | Jung | G06F 3/167 |
| 2020/0027451 | A1* | 1/2020 | Cantu | H04R 3/005 |

OTHER PUBLICATIONS

U.S. Appl. No. 16/694,744, filed Nov. 25, 2019, by Satpathy et al.
U.S. Appl. No. 16/726,492, filed Dec. 24, 2019, by Wang et al.
U.S. Appl. No. 16/720,635, filed Dec. 19, 2019, by Mathur et al.
McGrew et al., "The Galois/Counter Mode of Operation (GCM)," Conference Proceedings 2005, 2005 (Applicant points out, in accordance with MPEP 609.04(a), that the year of publication, 2005, is sufficiently earlier than the effective U.S. filing date, so that the particular month of publication is not in issue.) 43 pp.
Kite, "Understanding PDM Digital Audio," Audio Precision, Jan. 11, 2012, 9 pp.
Waterman et al., "The RISC-V Instruction Set Manual, vol. II: Privileged Architecture. Version 1.10 Chapter 7," May 7, 2017, 13 pp.
IEEE Std 802.11 ad-2012: "Part 11: Wireless LAN Medium Access Control (MAC) and Physical Layer (PHY) Specifications—Amendment 3: Enhancements for Very High Throughput in the 60 GHz Band", LAN/MAN Standards Committee of the IEEE Computer Society, Dec. 28, 2012, 628 Pages.
"SMS4 Encryption Algorithm for Wireless Networks," Version 1.03, May 15, 2008, 6 pp. (translated by Diffie et al.).
Aoki et al., "Specification of Camellia—a 128-bit Block Cipher," NTT and Mitsubishi Electric Corporation, Sep. 26, 2001, 35 pp.
International Search Report and Written Opinion of International Application No. PCT/US2020/059588, dated Feb. 12, 2021, 10 pp.

* cited by examiner

AUDIO SAMPLE PHASE ALIGNMENT IN AN ARTIFICIAL REALITY SYSTEM

CROSS REFERENCE

This application claims the benefit of U.S. Provisional Patent Application No. 62/938,114 filed on Nov. 20, 2019, which is hereby incorporated by reference herein in its entirety.

TECHNICAL FIELD

This disclosure generally relates to audio processing, including audio processing in artificial reality systems, such as virtual reality, mixed reality and/or augmented reality systems.

BACKGROUND

Artificial reality systems are becoming increasingly ubiquitous with applications in many fields such as computer gaming, health and safety, industrial, and education. For example, artificial reality systems are being incorporated into mobile devices, gaming consoles, personal computers, movie theaters, and theme parks. In general, artificial reality is a form of reality that has been adjusted in some manner before presentation to a user, which may include, e.g., a virtual reality, an augmented reality, a mixed reality, a hybrid reality, or some combination and/or derivatives thereof.

SUMMARY

This disclosure describes techniques that include aligning processing of audio samples collected by multiple audio sensors or microphones. In some examples, techniques are described for aligning processing of audio samples collected by two microphones, where one is enabled or turned on at an arbitrary time after the other is enabled or turned on. In some examples, audio samples collected by each such microphone may be processed by an audio processor in processing pipelines started at different times. As a result, the pipelines may complete processing at different times, thereby complicating use of such samples in further processing. To avoid this result, in one example, the audio processor may introduce a delay in starting the audio processing pipeline for a channel associated with the later-enabled microphone to ensure that the pipeline starts at the same time that a pipeline for the channel associated with the earlier-enabled microphone is started. In another example, the audio processor may use a synchronization signal to communicate to the later-started audio channel when to start its audio processing pipeline. If the later-started audio channel is signaled when the earlier-started audio channel is starting to process a new pipeline, the processing of audio data by the two channels may be aligned. Techniques are described for aligning processing of audio samples for channels that operate at the same frequency and at different frequencies.

The disclosed techniques may, in various implementations, provide one or more technical advantages. For instance, by aligning processing of audio samples, techniques for performing certain operations on audio samples (e.g., sound source identification, directional alignment, localization, mixing) are simplified and/or feasible. Further, by implementing techniques for aligning processing of audio samples, power-saving modes involving selectively turning on and off various microphones can be performed with little or no loss in actual or effective functionality when transitioning from a low power mode that uses only a small subset of microphones in a microphone array to a more robust power mode that uses a larger subset of microphones in the microphone array.

In some examples, this disclosure describes operations performed by an audio processing system in accordance with one or more aspects of this disclosure. In one specific example, this disclosure describes a system comprising a plurality of microphones, including a first microphone and second microphone; a control system configured to selectively transition the second microphone between an enabled state and a disabled state; and an audio processing system configured to: receive audio samples collected by the first microphone, detect a transition by the second microphone from the disabled state to the enabled state, perform phase alignment between audio samples collected by the first microphone and audio samples collected by the second microphone, and process the audio samples collected by the first microphone and the second microphone.

In another example, this disclosure describes a method comprising receiving, by an audio processing system in an artificial reality system having a first microphone and a second microphone, audio samples collected by a first microphone; detecting, by the audio processing system, a transition by the second microphone from a disabled state to an enabled state; performing, by the audio processing system, phase alignment between audio samples collected by the first microphone and audio samples collected by the second microphone; and processing, by the audio processing system, the audio samples collected by the first microphone and the second microphone.

In another example, this disclosure describes a computer-readable storage medium comprises instructions that, when executed, configure processing circuitry of a computing system to perform operations comprising receiving audio samples collected by a first microphone; detecting a transition by a second microphone from a disabled state to an enabled state; performing, by the audio processing system, phase alignment between audio samples collected by the first microphone and audio samples collected by the second microphone; and processing, by the audio processing system, the audio samples collected by the first microphone and the second microphone.

The details of one or more examples of the techniques of this disclosure are set forth in the accompanying drawings and the description below. Other features, objects, and advantages of the techniques will be apparent from the description and drawings, and from the claims.

DETAILED DESCRIPTION

Figure 1A:
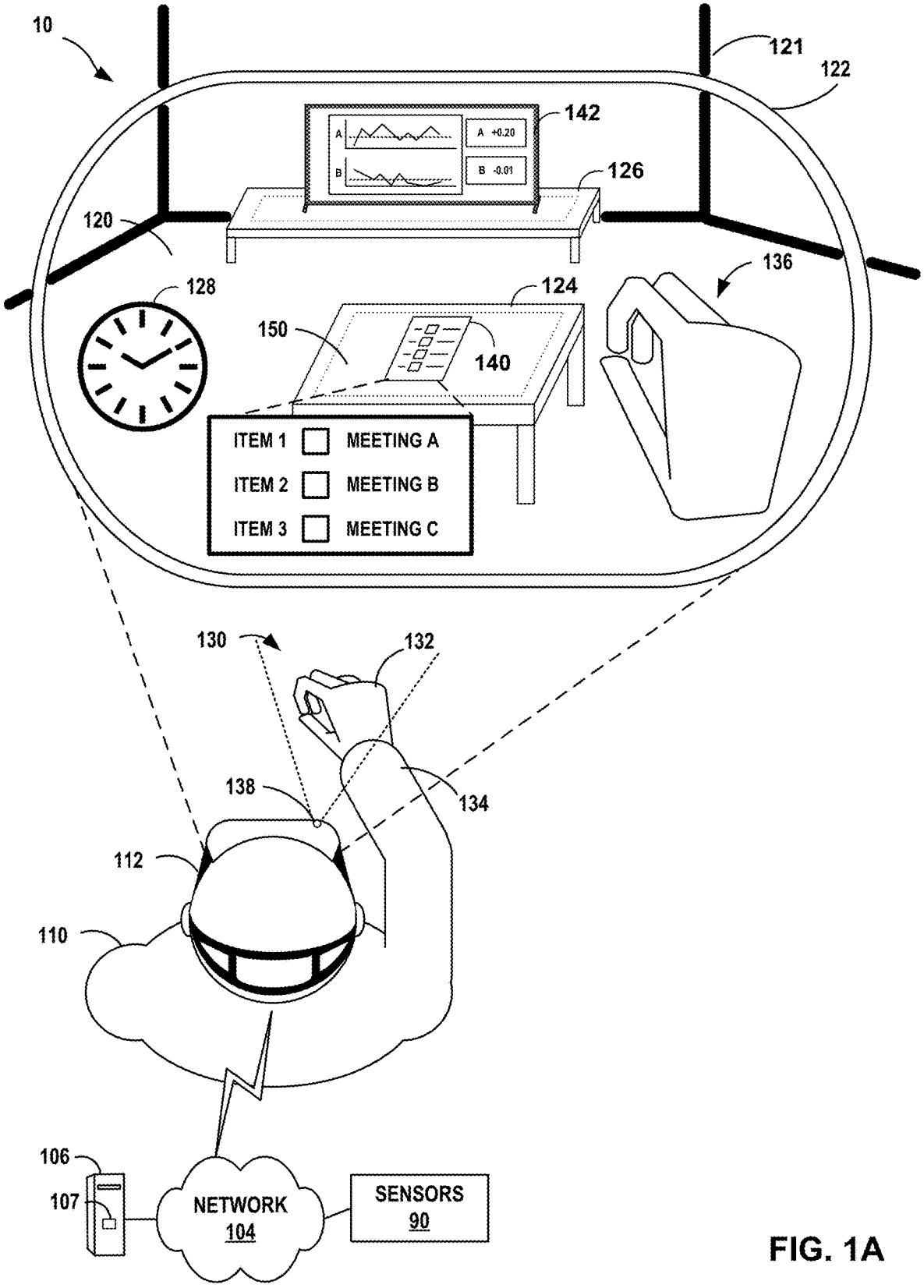
FIG. 1A is an illustration depicting an example artificial reality system, in accordance with one or more aspects of the present disclosure.

FIG. 1A is an illustration depicting an example artificial reality system 10, in accordance with one or more aspects of the present disclosure. In the example of FIG. 1A, artificial reality system 10 includes head mounted device (HMD) 112, console 106 and, in some examples, one or more external sensors 90. In some examples, external sensors 90 may include microphones and/or audio sensors.

As shown, HMD 112 is typically worn by user 110 and comprises an electronic display and optical assembly for presenting artificial reality content 122 to user 110. In addition, HMD 112 includes one or more sensors (e.g., accelerometers) for tracking motion of the HMD and may include one or more image capture devices 138, e.g., cameras, line scanners and the like, for capturing image data of the surrounding physical environment. Although illustrated as a head-mounted display, AR system 10 may alternatively, or additionally, include glasses or other display devices for presenting artificial reality content 122 to user 110.

In this example, console 106 is shown as a single computing device, such as a gaming console, workstation, a desktop computer, or a laptop. In other examples, console 106 may be distributed across a plurality of computing devices, such as a distributed computing network, a data center, or a cloud computing system. Console 106, HMD 112, and sensors 90 may, as shown in this example, be communicatively coupled via network 104, which may be a wired or wireless network, such as WiFi, a mesh network or a short-range wireless communication medium. Although HMD 112 is shown in this example as in communication with, e.g., tethered to or in wireless communication with, console 106, in some implementations HMD 112 operates as a stand-alone, mobile artificial reality system.

In general, artificial reality system 10 uses information captured from a real-world, 3D physical environment to render artificial reality content 122 for display to user 110. In the example of FIG. 1A, user 110 views the artificial reality content 122 constructed and rendered by an artificial reality application executing on console 106 and/or HMD 112. In some examples, artificial reality content 122 may comprise a mixture of real-world imagery (e.g., hand 132, earth 120, wall 121) and virtual objects (e.g., virtual content items 124, 126, 140 and 142). In the example of FIG. 1A, artificial reality content 122 comprises virtual content items 124, 126 represent virtual tables and may be mapped (e.g., pinned, locked, placed) to a particular position within artificial reality content 122. Similarly, artificial reality content 122 comprises virtual content item 142 that represents a virtual display device that is also mapped to a particular position within artificial reality content 122. A position for a virtual content item may be fixed, as relative to a wall or the earth, for instance. A position for a virtual content item may be variable, as relative to a user, for instance. In some examples, the particular position of a virtual content item within artificial reality content 122 is associated with a position within the real-world, physical environment (e.g., on a surface of a physical object).

In the example artificial reality experience shown in FIG. 1A, virtual content items 124, 126 are mapped to positions on the earth 120 and/or wall 121. The artificial reality system 10 may render one or more virtual content items in response to a determination that at least a portion of the location of virtual content items is in the field of view 130 of user 110. That is, virtual content appears only within artificial reality content 122 and does not exist in the real world, physical environment.

During operation, an artificial reality application constructs artificial reality content 122 for display to user 110 by tracking and computing pose information for a frame of reference, typically a viewing perspective of HMD 112. Using HMD 112 as a frame of reference, and based on a current field of view 130 as determined by a current estimated pose of HMD 112, the artificial reality application renders 3D artificial reality content which, in some examples, may be overlaid, at least in part, upon the real-world, 3D physical environment of user 110. During this process, the artificial reality application uses sensed data received from HMD 112, such as movement information and user commands, and, in some examples, data from any external sensors 90, such as external cameras or microphones, to capture 3D information within the real world, physical environment, such as motion by user 110 and/or feature tracking information with respect to user 110. Based on the sensed data, the artificial reality application determines a current pose for the frame of reference of HMD 112 and, in accordance with the current pose, renders the artificial reality content 122.

Artificial reality system 10 may trigger generation and rendering of virtual content items based on a current field of view 130 of user 110, as may be determined by real-time gaze tracking of the user, or other conditions. More specifically, image capture devices 138 of HMD 112 capture image data representative of objects in the real-world, physical environment that are within a field of view 130 of image capture devices 138. Field of view 130 typically corresponds with the viewing perspective of HMD 112. In some examples, the artificial reality application presents artificial reality content 122 comprising mixed reality and/or augmented reality. In some examples, the artificial reality application may render images of real-world objects, such as the portions of hand 132 and/or arm 134 of user 110, that are within field of view 130 along with the virtual objects, such as within artificial reality content 122. In other examples, the artificial reality application may render virtual representations of the portions of hand 132 and/or arm 134 of user 110 that are within field of view 130 (e.g., render real-world objects as virtual objects) within artificial reality content 122. In either example, user 110 is able to view the portions of their hand 132, arm 134, and/or any other real-world objects that are within field of view 130 within artificial reality content 122. In other examples, the artificial reality application may not render representations of the hand 132 or arm 134 of the user.

During operation, artificial reality system 10 performs object recognition within image data captured by image capture devices 138 of HMD 112 to identify hand 132, including optionally identifying individual fingers or the thumb, and/or all or portions of arm 134 of user 110. Further, artificial reality system 10 tracks the position, orientation, and configuration of hand 132 (optionally including particular digits of the hand), and/or portions of arm 134 over a sliding window of time.

Rather than requiring only artificial reality applications that are typically fully immersive of the whole field of view 130 within artificial reality content 122, artificial reality system 10 may enable generation and display of artificial reality content 122 by a plurality of artificial reality applications that are concurrently running and which output content for display in a common scene. Artificial reality applications may include environment applications, placed applications, and floating applications. Environment applications may define a scene for the AR environment that serves as a backdrop for one or more applications to become active. For example, environment applications place a user in the scene, such as a beach, office, environment from a fictional location (e.g., from a game or story), environment of a real location, or any other environment. In the example of FIG. 1A, the environment application provides a living room scene within artificial reality content 122.

A placed application is a fixed application that is expected to remain rendered (e.g., no expectation to close the applications) within artificial reality content 122. For example, a placed application may include surfaces to place other objects, such as a table, shelf, or the like. In some examples, a placed application includes decorative applications, such as pictures, candles, flowers, game trophies, or any ornamental item to customize the scene. In some examples, a placed application includes functional applications (e.g., widgets) that allow quick glancing at important information (e.g., agenda view of a calendar). In the example of FIG. 1A, artificial reality content 122 includes virtual tables 124 and 126 that include surfaces to place other objects.

A floating application may include an application implemented on a "floating window." For example, a floating application may include 2D user interfaces, 2D applications (e.g., clock, calendar, etc.), or the like. In the example of FIG. 1A, a floating application may include clock application 128 that is implemented on a floating window within artificial reality content 122. In some examples, floating applications may integrate 3D content. For example, a floating application may be a flight booking application that provides a 2D user interface to view and select from a list of available flights and is integrated with 3D content such as a 3D visualization of a seat selection. As another example, a floating application may be a chemistry teaching application that provides a 2D user interface of a description of a molecule and also shows 3D models of the molecules. In another example, a floating application may be a language learning application that may also show a 3D model of objects with the definition and/or 3D charts for learning progress. In a further example, a floating application may be a video chat application that shows a 3D reconstruction of the face of the person on the other end of the line.

As further described below, artificial reality system 10 includes an application engine 107 that is configured to execute one or more artificial reality applications, including those that may collaboratively build and share a common artificial reality environment. In one example, application engine 107 receives modeling information of objects of a plurality of artificial reality applications. For instance, application engine 107 receives modeling information of agenda object 140 of an agenda application to display agenda information. Application engine 107 also receives modeling information of virtual display object 142 of a media content application to display media content (e.g., GIF, photo, application, live-stream, video, text, web-browser, drawing, animation, 3D model, representation of data files (including two-dimensional and three-dimensional datasets), or any other visible media).

In some examples, the artificial reality applications may, in accordance with the techniques, specify any number of offer areas (e.g., zero or more) that define objects and surfaces suitable for placing the objects. In some examples, the artificial reality application includes metadata describing the offer area, such as a specific node to provide the offer area, pose of the offer area relative to that node, surface shape of the offer area and size of the offer area. In the example of FIG. 1A, the agenda application defines offer area 150 on the surface of virtual table 124 to display agenda object 140. The agenda application may specify, for example, that the position and orientation (e.g., pose) of offer area 150 is on the top of virtual table 124, the shape of offer area 150 as a rectangle, and the size of offer area 150 for placing agenda object 140. As another example, a media content application defines offer area 152 of virtual display object 142. The media content application may specify, for example, that the position and orientation (i.e., pose) of offer area 152 for placing virtual display object 142, the shape of offer 152 as a rectangle, and the size of offer area 150 for placing virtual display object 142.

The artificial reality applications may also request one or more attachments that describe connections between offer areas and the objects placed on them. In some examples, attachments include additional attributes, such as whether the object can be interactively moved or scaled. In the example of FIG. 1A, the agenda application requests for an attachment between offer area 150 and agenda object 140 and includes additional attributes indicating agenda object 140 may be interactively moved and/or scaled within offer area 150. Similarly, the media content application requests for an attachment between offer area 152 and virtual display object 142 and includes additional attributes indicating virtual display object 142 is fixed within offer area 152.

Alternatively, or additionally, objects are automatically placed on offer areas. For example, a request for attachment for an offer area may specify dimensions of the offer area and the object being placed, semantic information of the offer area and the object being placed, and/or physics information of the offer area and the object being placed. Dimensions of an offer area may include the necessary amount of space for an offer area to support the placement of the object and dimensions of the object may include the size of object. In some examples, an object is automatically placed in a scene based on semantic information, such as the type of object, the type of offer area, and what types of objects can be found on this type of area. For example, an offer area on a body of water may have semantic information specifying that only water compatible objects (e.g., boat) can be placed on the body of water. In some examples, an object is automatically placed in a scene based on physics (or pseudo-physics) information, such as whether an object has enough support in the offer area, whether the object will slide or fall, whether the object may collide with other objects, or the like.

In some examples, console 106, HMD 112, and/or other components of system 10 of FIG. 1A may be implemented to control an array of microphones, including selectively enabling and disabling such microphones to conserve power when fewer microphones might not be needed by system 20 and/or HMD 112. In some examples, console 106, HMD 112, and/or other components of system 20 may, when such microphones are enabled or disabled, perform operations to align processing of audio samples, where such microphones may be turned on asynchronously and/or at arbitrary times.

The system and techniques may provide one or more technical advantages and practical applications. For example, by aligning processing of audio samples, techniques for performing certain operations on audio samples (e.g., sound source identification, directional alignment, localization, mixing) are simplified and/or feasible. Further, by implementing techniques for aligning processing of audio samples, power-saving modes involving selectively turning on and off various microphones can be performed with little or no loss in functionality when transitioning from a low power mode that uses only a small subset of microphones in a microphone array to a more robust power mode that uses a larger subset of microphones in the microphone array.

Figure 1B:
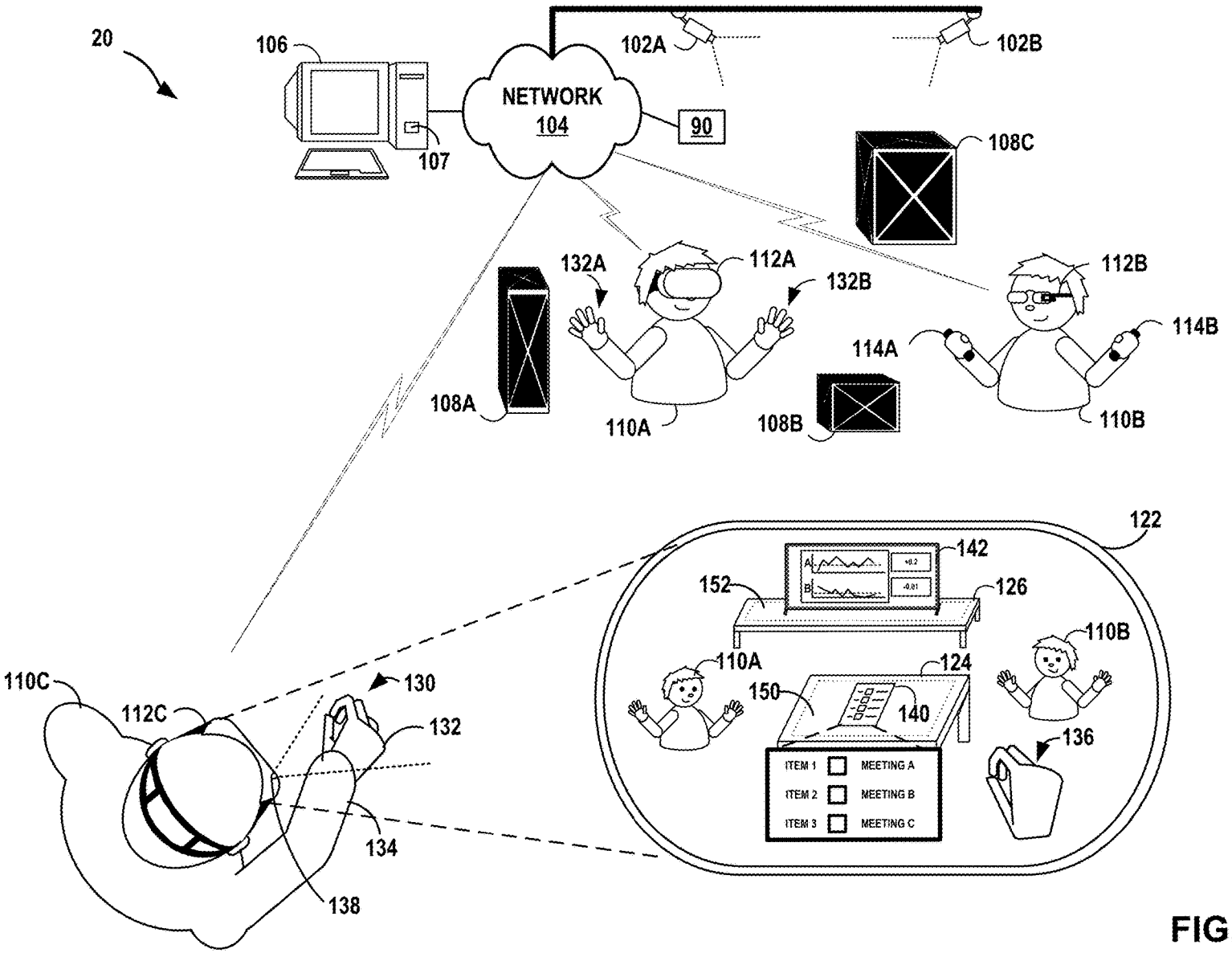
FIG. 1B is an illustration depicting another example artificial reality system, in accordance with one or more aspects of the present disclosure.

FIG. 1B is an illustration depicting another example artificial reality system 20 that generates an artificial reality scene, in accordance with one or more aspects of the present disclosure. Similar to artificial reality system 10 of FIG. 1A, in some examples, artificial reality system 20 of FIG. 1B may generate and render a common scene including objects for a plurality of artificial reality applications within a multi-user artificial reality environment. Artificial reality system 20 may also, in various examples, provide interactive placement and/or manipulation of virtual objects in response detection of one or more particular gestures of a user within the multi-user artificial reality environment.

In the example of FIG. 1B, artificial reality system 20 includes external cameras 102A and 102B (collectively, "external cameras 102"), HMDs 112A-112C (collectively, "HMDs 112"), controllers 114A and 114B (collectively, "controllers 114"), console 106, and sensors 90. As shown in FIG. 1B, artificial reality system 20 represents a multi-user environment in which a plurality of artificial reality applications executing on console 106 and/or HMDs 112 may be concurrently running and displayed on a common rendered scene presented to each of users 110A-110C (collectively, "users 110") based on a current viewing perspective of a corresponding frame of reference for the respective user. That is, in this example, each of the plurality of artificial reality applications constructs artificial content by tracking and computing pose information for a frame of reference for each of HMDs 112. Artificial reality system 20 uses data received from cameras 102, HMDs 112, and controllers 114 to capture 3D information within the real world environment, such as motion by users 110 and/or tracking information with respect to users 110 and objects 108, for use in computing updated pose information for a corresponding frame of reference of HMDs 112. As one example, the plurality of artificial reality applications may render on the same scene, based on a current viewing perspective determined for HMD 112C, artificial reality content 122 having virtual objects 124, 126, 140, and 142 as spatially overlaid upon real world objects 108A-108C (collectively, "real world objects 108"). Further, from the perspective of HMD 112C, artificial reality system 20 renders avatars 122A, 122B based upon the estimated positions for users 110A, 110B, respectively.

Each of HMDs 112 concurrently operates within artificial reality system 20. In the example of FIG. 1B, each of users 110 may be a "participant" (or "player") in the plurality of artificial reality applications, and any of users 110 may be a "spectator" or "observer" in the plurality of artificial reality applications. HMD 112C may operate substantially similar to HMD 112 of FIG. 1A by tracking hand 132 and/or arm 134 of user 110C, and rendering the portions of hand 132 that are within field of view 130 as virtual hand 136 within artificial reality content 122. HMD 112B may receive user inputs from controllers 114A held by user 110B. HMD 112A may also operate substantially similar to HMD 112 of FIG. 1A and receive user inputs by tracking movements of hands 132A, 132B of user 110A. HMD 112B may receive user inputs from controllers 114 held by user 110B. Controllers 114 may be in communication with HMD 112B using near-field communication of short-range wireless communication such as Bluetooth, using wired communication links, or using another type of communication links.

As shown in FIG. 1B, in addition to or alternatively to image data captured via camera 138 of HMD 112C, input data from external cameras 102 may be used to track and detect particular motions, configurations, positions, and/or orientations of hands and arms of users 110, such as hand 132 of user 110C, including movements of individual and/or combinations of digits (fingers, thumb) of the hand.

In some aspects, the artificial reality application can run on console 106, and can utilize image capture devices 102A and 102B to analyze configurations, positions, and/or orientations of hand 132B to identify input gestures that may be performed by a user of HMD 112A. The application engine 107 may render virtual content items, responsive to such gestures, motions, and orientations, in a manner similar to that described above with respect to FIG. 1A. For example, application engine 107 may provide interactive placement and/or manipulation of agenda object 140 and/or virtual display object 142 responsive to such gestures, motions, and orientations, in a manner similar to that described above with respect to FIG. 1A.

Image capture devices 102 and 138 may capture images in the visible light spectrum, the infrared spectrum, or other spectrum. Image processing described herein for identifying objects, object poses, and gestures, for example, may include processing infrared images, visible light spectrum images, and so forth.

In some examples, console 106, HMD 112, and/or other components of system 20 of FIG. 1B may be implemented to control an array of microphones, including selectively enabling and disabling such microphones to conserve power when fewer microphones might not be needed by system 20 and/or HMD 112. In some examples, console 106, HMD 112, and/or other components of system 20 may, when such microphones are enabled or disabled, align processing of audio samples collected by microphones turned on asynchronously and/or at arbitrary times.

Figure 2A:
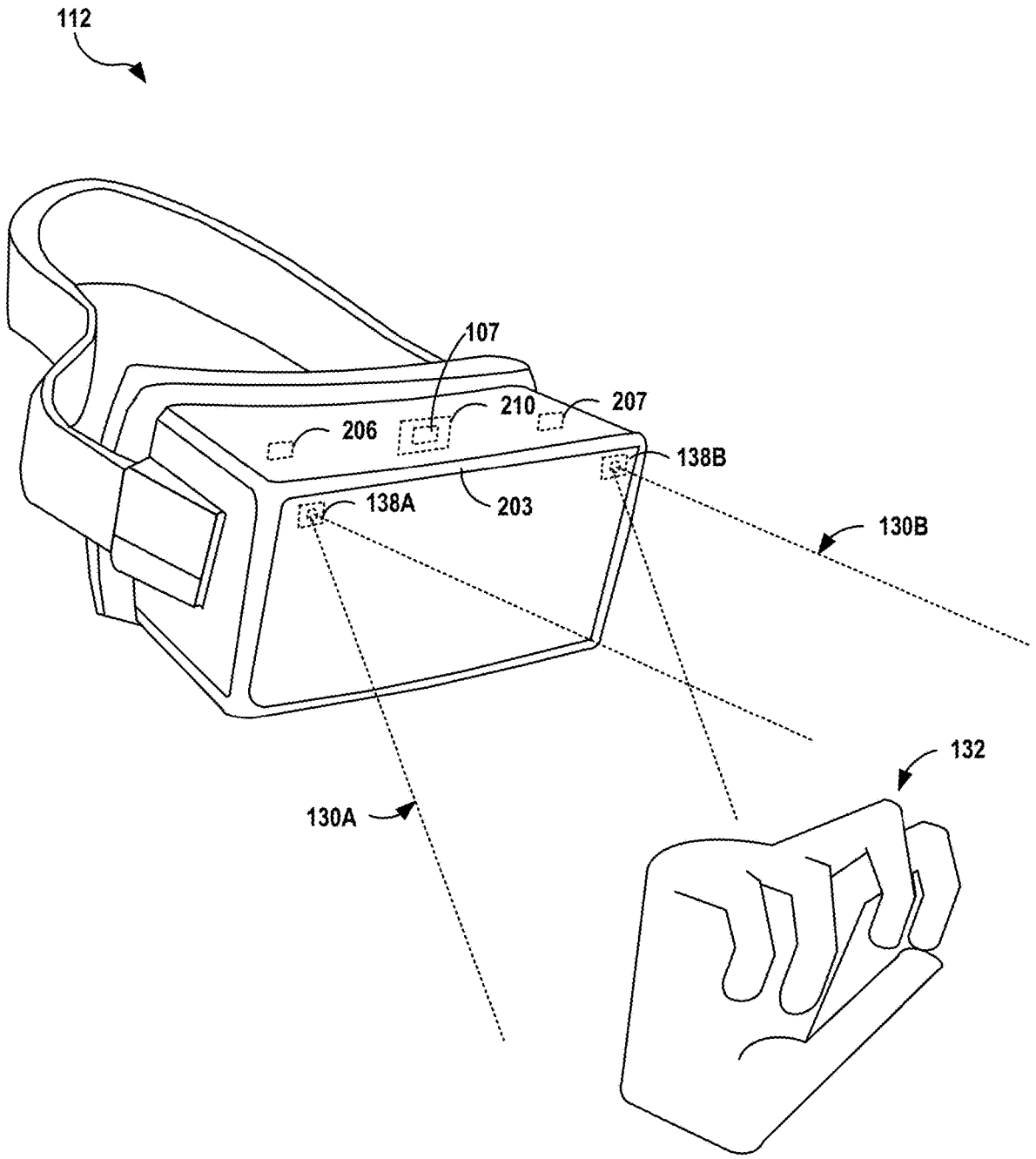
FIG. 2A is an illustration depicting an example HMD configured to collect audio samples from a microphone array, in accordance with one or more aspects of the present disclosure.

FIG. 2A is an illustration depicting an example HMD 112 capable of and/or configured to collect audio samples from a microphone array, in accordance with one or more aspects of the present disclosure. HMD 112 of FIG. 2A may be an example of any of HMDs 112 of FIGS. 1A and 1B. HMD 112 may be part of an artificial reality system, such as artificial reality systems 10, 20 of FIGS. 1A, 1B, or may operate as a stand-alone, mobile artificial realty system configured to implement the techniques described herein.

In this example, HMD 112 includes a front rigid body and a band to secure HMD 112 to a user. In addition, HMD 112 includes an interior-facing electronic display 203 configured to present artificial reality content to the user. Electronic display 203 may be any suitable display technology, such as liquid crystal displays (LCD), quantum dot display, dot matrix displays, light emitting diode (LED) displays, organic light-emitting diode (OLED) displays, cathode ray tube (CRT) displays, e-ink, or monochrome, color, or any other type of display capable of generating visual output. In some examples, the electronic display is a stereoscopic display for providing separate images to each eye of the user. In some examples, the known orientation and position of display 203 relative to the front rigid body of HMD 112 is used as a frame of reference, also referred to as a local origin, when tracking the position and orientation of HMD 112 for rendering artificial reality content according to a current viewing perspective of HMD 112 and the user. In other examples, HMD may take the form of other wearable head mounted displays, such as glasses or goggles.

As further shown in FIG. 2A, in this example, HMD 112 further includes one or more sensors 206, such as one or more motion sensors, accelerometers (also referred to as inertial measurement units or "IMUs") that output data indicative of current acceleration of HMD 112, GPS sensors that output data indicative of a location of HMD 112, radar or sonar that output data indicative of distances of HMD 112 from various objects, or other sensors that may provide indications of a location or orientation of HMD 112 or other objects within a physical environment. HMD 112 may include one or more audio sensors or microphones 207 for capturing audio from the physical environment. Such microphones 207 may be arranged in an array and may be capable of being used for performing directional alignment, sound source identification, direction of arrival estimation, audio localization, and other procedures. In some examples, each of microphones can be selectively enabled and disabled or turned on or off to conserve power.

Moreover, HMD 112 may include integrated image capture devices 138A and 138B (collectively, "image capture devices 138"), such as video cameras, laser scanners, Doppler radar scanners, depth scanners, or the like, configured to output image data representative of the physical environment. More specifically, image capture devices 138 capture image data representative of objects (including hand 132) in the physical environment that are within a field of view 130A, 130B of image capture devices 138, which typically corresponds with the viewing perspective of HMD 112. HMD 112 includes an internal control unit 210, which may include an internal power source and one or more printed-circuit boards having one or more processors, memory, and hardware to provide an operating environment for executing programmable operations to process sensed data and present artificial reality content on display 203.

In some examples, application engine 107 controls interactions to the objects on the scene, and delivers input and other signals for interested artificial reality applications. For example, control unit 210 is configured to, based on the sensed data, identify a specific gesture or combination of gestures performed by the user and, in response, perform an action. As explained herein, control unit 210 may perform object recognition within image data captured by image capture devices 138 to identify a hand 132, fingers, thumb, arm or another part of the user, and track movements of the identified part to identify pre-defined gestures performed by the user. In response to identifying a pre-defined gesture, control unit 210 takes some action, such as generating and rendering artificial reality content that is interactively placed or manipulated for display on electronic display 203.

In accordance with the techniques described herein, HMD 112 may detect gestures of hand 132 and, based on the detected gestures, shift application content items placed on offer areas within the artificial reality content to another location within the offer area or to another offer area within the artificial reality content. For instance, image capture devices 138 may be configured to capture image data representative of a physical environment. Control unit 210 may output artificial reality content on electronic display 203. Control unit 210 may render a first offer area (e.g., offer area 150 of FIGS. 1A and 1B) that includes an attachment that connects an object (e.g., agenda object 140 of FIGS. 1A and 1B). Control unit 210 may identify, from the image data, a selection gesture, where the selection gesture is a configuration of hand 132 that performs a pinching or grabbing motion to the object within offer area, and a subsequent translation gesture (e.g., moving) of hand 132 from the first offer area to a second offer area (e.g., offer area 152 of FIGS. 1A and 1B). In response to control unit 210 identifying the selection gesture and the translation gesture, control unit 210 may process the attachment to connect the object on the second offer area and render the object placed on the second offer area.

Figure 2B:
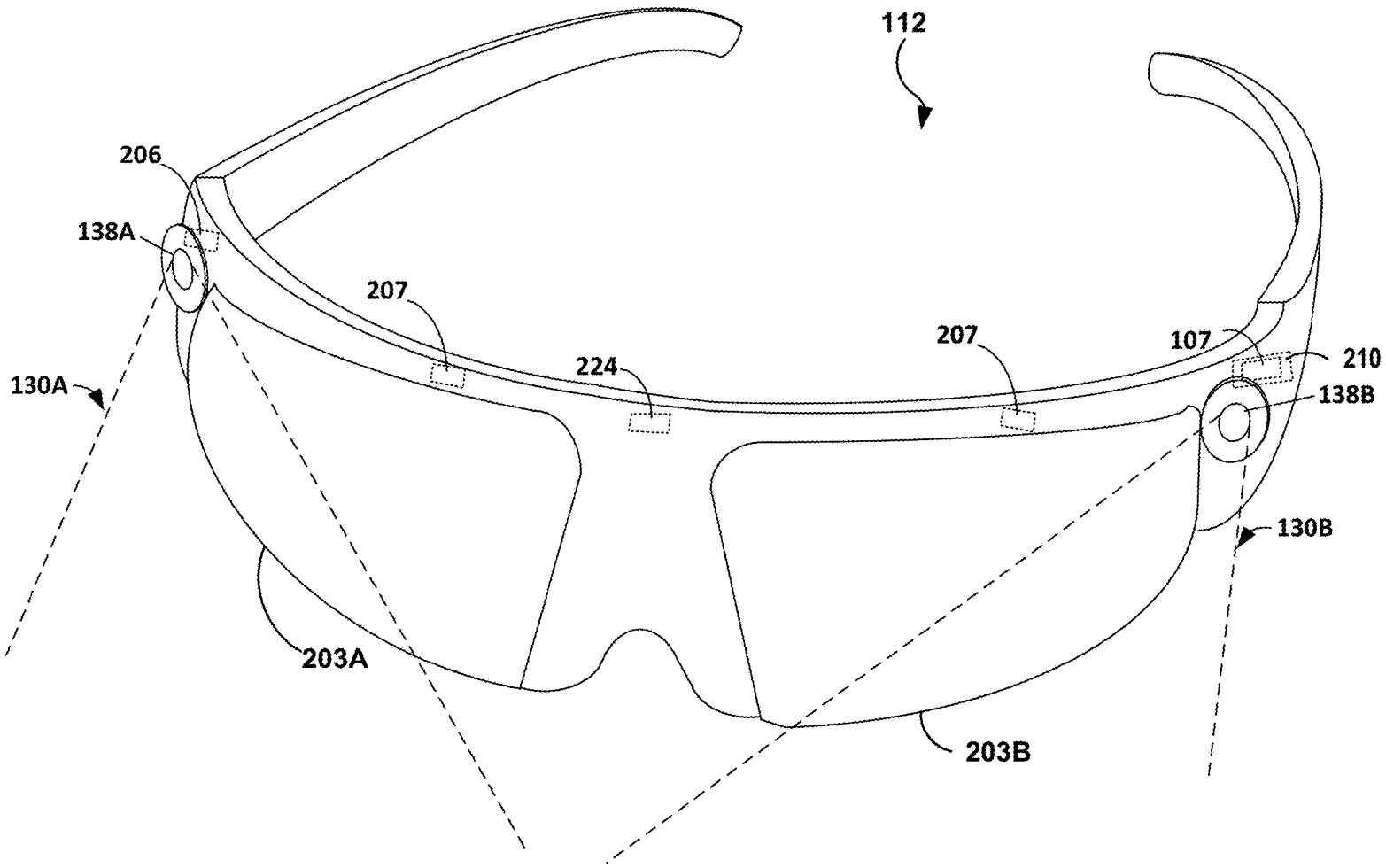
FIG. 2B is an illustration depicting another example HMD configured to collect audio samples from a microphone array, in accordance with one or more aspects of the present disclosure.

FIG. 2B is an illustration depicting another example HMD 112 capable of and/or configured to collect audio samples from a microphone array, in accordance with one or more aspects of the present disclosure. As shown in FIG. 2B, HMD 112 may take the form of glasses. HMD 112 of FIG. 2A may be an example of any of HMDs 112 of FIGS. 1A and 1B. HMD 112 may be part of an artificial reality system, such as artificial reality systems 10, 20 of FIGS. 1A, 1B, or may operate as a stand-alone, mobile artificial realty system configured to implement the techniques described herein.

In this example, HMD 112 are glasses comprising a front frame including a bridge to allow the HMD 112 to rest on a user's nose and temples (or "arms") that extend over the user's ears to secure HMD 112 to the user. In addition, HMD 112 of FIG. 2B includes interior-facing electronic displays 203A and 203B (collectively, "electronic displays 203") configured to present artificial reality content to the user. Electronic displays 203 may be any suitable display technology, such as liquid crystal displays (LCD), quantum dot display, dot matrix displays, light emitting diode (LED) displays, organic light-emitting diode (OLED) displays, cathode ray tube (CRT) displays, e-ink, or monochrome, color, or any other type of display capable of generating visual output. In the example shown in FIG. 2B, electronic displays 203 form a stereoscopic display for providing separate images to each eye of the user. In some examples, the known orientation and position of display 203 relative to the front frame of HMD 112 is used as a frame of reference, also referred to as a local origin, when tracking the position and orientation of HMD 112 for rendering artificial reality content according to a current viewing perspective of HMD 112 and the user.

As further shown in FIG. 2B, in this example, HMD 112 further includes one or more sensors 206, such as one or more motion sensors or accelerometers (also referred to as inertial measurement units or "IMUs") that output data indicative of current acceleration of HMD 112, GPS sensors that output data indicative of a location of HMD 112, radar or sonar that output data indicative of distances of HMD 112 from various objects, or other sensors that provide indications of a location or orientation of HMD 112 or other objects within a physical environment. HMD 112 of FIG. 2B may also include one or more audio sensors or microphones 207 for capturing audio from the physical environment. Such microphones 207 may be arranged in an array and capable of being used for performing directional alignment, sound source identification, direction of arrival estimation, audio localization, and other procedures. In some examples, each of microphones can be selectively turned on or off to conserve power. Moreover, HMD 112 of FIG. 2B may include integrated image capture devices 138A and 138B (collectively, "image capture devices 138"), such as video cameras, laser scanners, Doppler radar scanners, depth scanners, or the like, configured to output image data representative of the physical environment. HMD 112 includes an internal control unit 210, which may include an internal power source and one or more printed-circuit boards having one or more processors, memory, and hardware to provide an operating environment for executing programmable operations to process sensed data and present artificial reality content on display 203.

Figure 3:
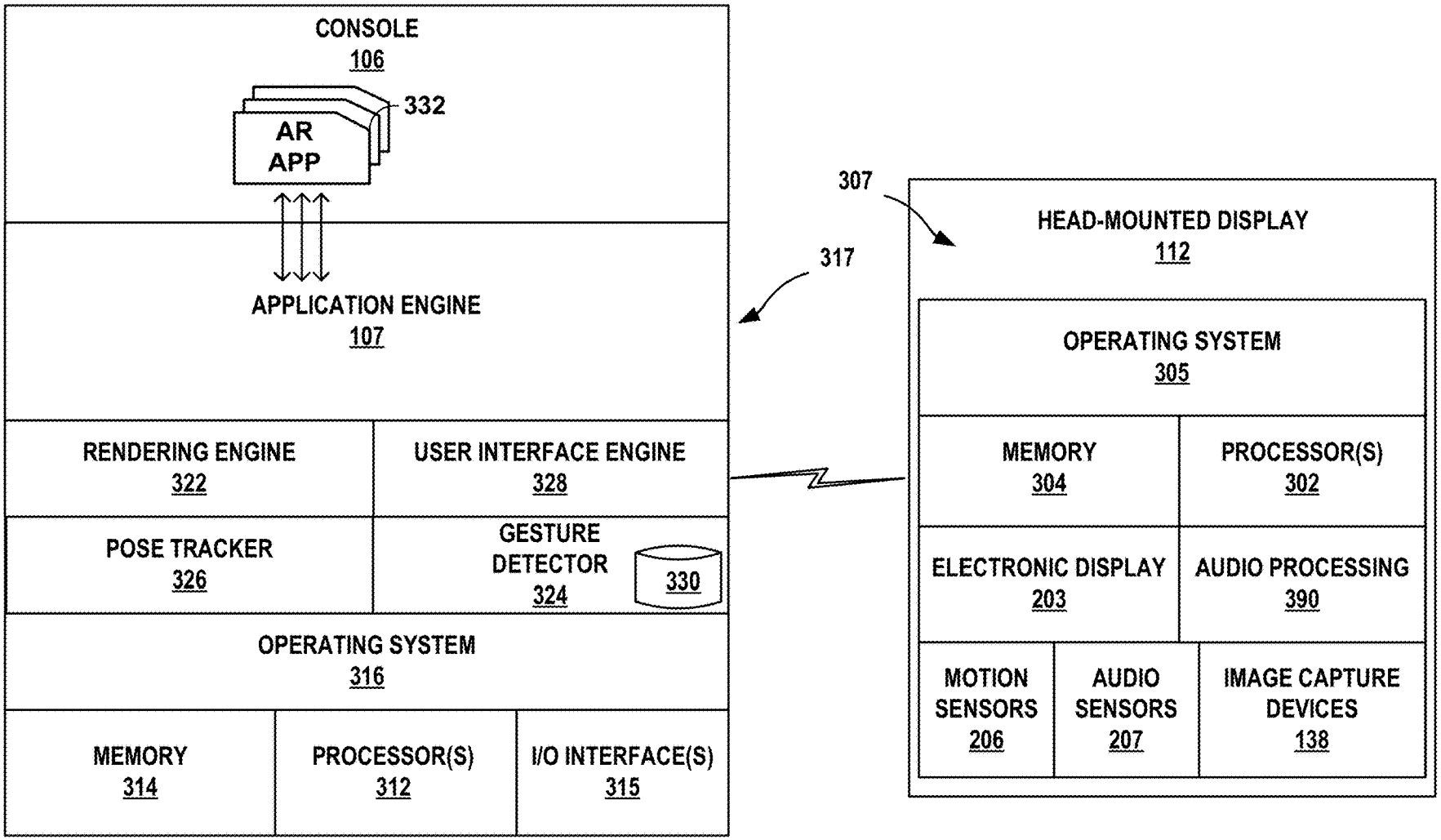
FIG. 3 is a block diagram showing example implementations of a console and HMD of an artificial reality system that may selectively turn on and off various audio sensors, in accordance with one or more aspects of the present disclosure.

FIG. 3 is a block diagram showing example implementations of a console 106 and HMD 112 of an artificial reality system that may selectively turn on and off various audio sensors, in accordance with one or more aspects of the present disclosure. In the example of FIG. 3, console 106 performs pose tracking, gesture detection, and generation and rendering of multiple artificial reality applications 322 that may be concurrently running and outputting content for display within a common 3D AR scene on electronic display 203 of HMD 112.

In this example, HMD 112 includes one or more processors 302 and memory 304 that, in some examples, provide a computer platform for executing an operating system 305, which may be an embedded, real-time multitasking operating system, for instance, or other type of operating system. In turn, operating system 305 provides a multitasking operating environment for executing one or more software components 307, including application engine 107. As discussed with respect to the examples of FIGS. 2A and 2B, processors 302 are coupled to electronic display 203, sensors 206 and image capture devices 138. In some examples, processors 302 and memory 304 may be separate, discrete components. In other examples, memory 304 may be on-chip memory collocated with processors 302 within a single integrated circuit.

HMD 112 may include audio processing module 390, which may perform operations relating to processing audio samples collected one or more audio sensors or microphones 207. audio processing module 390 may include a control system or controller logic that is capable of or configured to selectively transition each of sensors 207 into an enabled or disabled state (e.g., "turn on" or "turn off" microphones 207).

In general, console 106 is a computing device that processes image and tracking information received from cameras 102 (FIG. 1B) and/or HMD 112 to perform gesture detection and user interface generation for HMD 112. In some examples, console 106 is a single computing device, such as a workstation, a desktop computer, a laptop, or gaming system. In some examples, at least a portion of console 106, such as processors 312 and/or memory 314, may be distributed across a cloud computing system, a data center, or across a network, such as the Internet, another public or private communications network, for instance, broadband, cellular, Wi-Fi, and/or other types of communication networks for transmitting data between computing systems, servers, and computing devices.

In the example of FIG. 3, console 106 includes one or more processors 312 and memory 314 that, in some examples, provide a computer platform for executing an operating system 316, which may be an embedded, real-time multitasking operating system, for instance, or other type of operating system. In turn, operating system 316 provides a multitasking operating environment for executing one or more software components 317. Processors 312 are coupled to one or more I/O interfaces 315, which provides one or more I/O interfaces for communicating with external devices, such as a keyboard, game controllers, display devices, image capture devices, HMDs, and the like. Moreover, the one or more I/O interfaces 315 may include one or more wired or wireless network interface controllers (NICs) for communicating with a network, such as network 104. Each of processors 302, 312 may comprise any one or more of a multi-core processor, a controller, a digital signal processor (DSP), an application specific integrated circuit (ASIC), a field-programmable gate array (FPGA), or equivalent discrete or integrated logic circuitry. Memory 304, 314 may comprise any form of memory for storing data and executable software instructions, such as random-access memory (RAM), read only memory (ROM), programmable read only memory (PROM), erasable programmable read only memory (EPROM), electronically erasable programmable read only memory (EEPROM), and flash memory.

Software applications 317 of console 106 operate to provide an aggregation of artificial reality applications on a common scene. In this example, software applications 317 include application engine 107, rendering engine 322, gesture detector 324, pose tracker 326, and user interface engine 328.

In general, application engine 107 includes functionality to provide and present an aggregation of content generated by a plurality of artificial reality applications 332, e.g., a teleconference application, a gaming application, a navigation application, an educational application, training or simulation applications, and the like. Application engine 107 may include, for example, one or more software packages, software libraries, hardware drivers, and/or Application Program Interfaces (APIs) for implementing an aggregation of a plurality of artificial reality applications 332 on console 106.

Based on the sensed data from any of the image capture devices 138 or 102, or other sensor devices, gesture detector 324 analyzes the tracked motions, configurations, positions, and/or orientations of HMD 112 and/or physical objects (e.g., hands, arms, wrists, fingers, palms, thumbs) of the user to identify one or more gestures performed by user 110. More specifically, gesture detector 324 analyzes objects recognized within image data captured by image capture devices 138 of HMD 112 and/or sensors 90 and external cameras 102 to identify a hand and/or arm of user 110, and track movements of the hand and/or arm relative to HMD 112 to identify gestures performed by user 110. Gesture detector 324 may track movement, including changes to position and orientation, of hand, digits, and/or arm based on the captured image data, and compare motion vectors of the objects to one or more entries in gesture library 330 to detect a gesture or combination of gestures performed by user 110.

Some entries in gesture library 330 may each define a gesture as a series or pattern of motion, such as a relative path or spatial translations and rotations of a user's hand, specific fingers, thumbs, wrists and/or arms. Some entries in gesture library 330 may each define a gesture as a configuration, position, and/or orientation of the user's hand and/or arms (or portions thereof) at a particular time, or over a period of time. Other examples of type of gestures are possible. In addition, each of the entries in gesture library 330 may specify, for the defined gesture or series of gestures, conditions that are required for the gesture or series of gestures to trigger an action, such as spatial relationships to a current field of view of HMD 112, spatial relationships to the particular region currently being observed by the user, as may be determined by real-time gaze tracking of the individual, types of artificial content being displayed, types of applications being executed, and the like.

Each of the entries in gesture library 330 further may specify, for each of the defined gestures or combinations/series of gestures, a desired response or action to be performed by software applications 317. For example, in accordance with the techniques of this disclosure, certain specialized gestures may be pre-defined such that, in response to detecting one of the pre-defined gestures, application engine 107 may control interactions to the objects on the rendered scene, and delivers input and other signals for interested artificial reality applications.

As an example, gesture library 330 may include entries that describe a selection gesture, a translation gesture (e.g., moving, rotating), modification/altering gesture (e.g., scaling), or other gestures that may be performed by users. Gesture detector 324 may process image data from image capture devices 138 to analyze configurations, positions, motions, and/or orientations of a user's hand to identify a gesture, such as a selection gesture. For instance, gesture detector 324 may detect a particular configuration of the hand that represents the selection of an object, the configuration being the hand being positioned to grab the object placed on a first offer area. This grabbing position could be, in some instances, a two-finger pinch where two or more fingers of a user's hand move closer to each other, performed in proximity to the object. Gesture detector 324 may subsequently detect a translation gesture, where the user's hand or arm moves from a first offer area to another location of the first offer area or to a second offer area. Gesture detector may also detect a releasing gesture, where two or more fingers of a user's hand move further from each other. Once the object is released to the second offer area, application engine 107 processes the attachment to connect the object to the second offer area.

In some examples, console 106, HMD 112, and/or other components of FIG. 3 may be implemented to control an array of audio sensors 207, including selectively enabling and disabling such sensors to conserve power when fewer sensors might not be needed by system 20 and/or HMD 112. In some examples, console 106, HMD 112, and/or other components of FIG. 3 may, when such sensors are enabled or disabled, perform techniques to align processing of audio samples, where such sensors may be turned on asynchronously, at arbitrary times.

Figure 4:
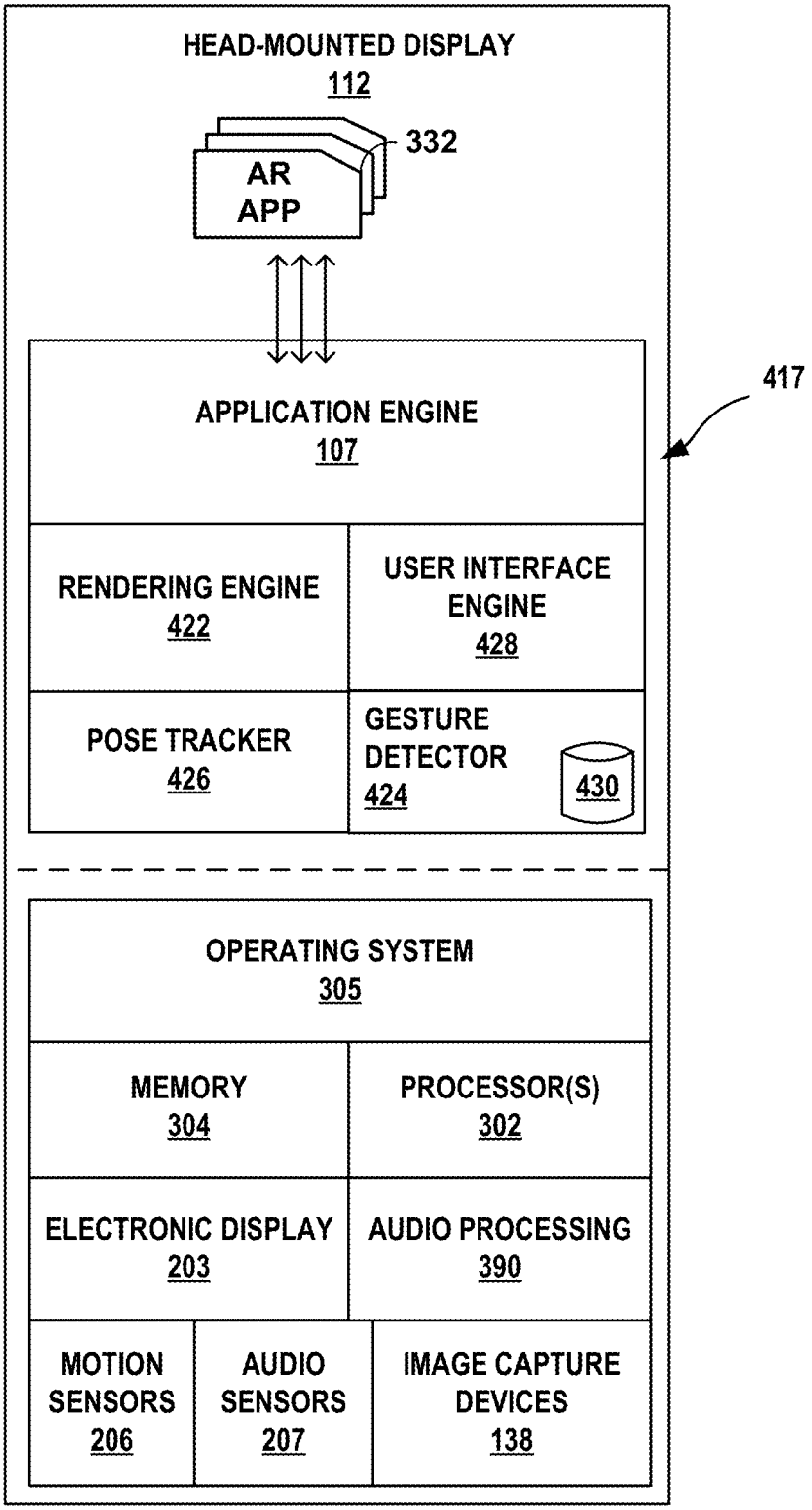
FIG. 4 is a block diagram depicting an example in which HMD of the artificial reality system that may selectively turn on and off various audio sensors, in accordance with one or more aspects of the present disclosure.

FIG. 4 is a block diagram depicting an example in which HMD 112 of the artificial reality system that may selectively turn on and off various audio sensors, in accordance with one or more aspects of the present disclosure. In this example, similar to FIG. 3, HMD 112 includes one or more processors 302 and memory 304 that, in some examples, provide a computer platform for executing an operating system 305, which may be an embedded, real-time multitasking operating system, for instance, or other type of operating system. In turn, operating system 305 provides a multitasking operating environment for executing one or more software components 417. Moreover, processor(s) 302 are coupled to electronic display 203, sensors 206, audio processing module 390, and image capture devices 138.

In some examples, HMD 112 may be implemented to control an array of audio sensors 207, including selectively enabling and disabling such sensors to conserve power when fewer sensors might not be needed by system 20 and/or HMD 112. In some examples, HMD 112 may, when such sensors are enabled or disabled, perform techniques to align processing of audio samples, where such sensors may be turned on asynchronously, at arbitrary times.

Figure 5:
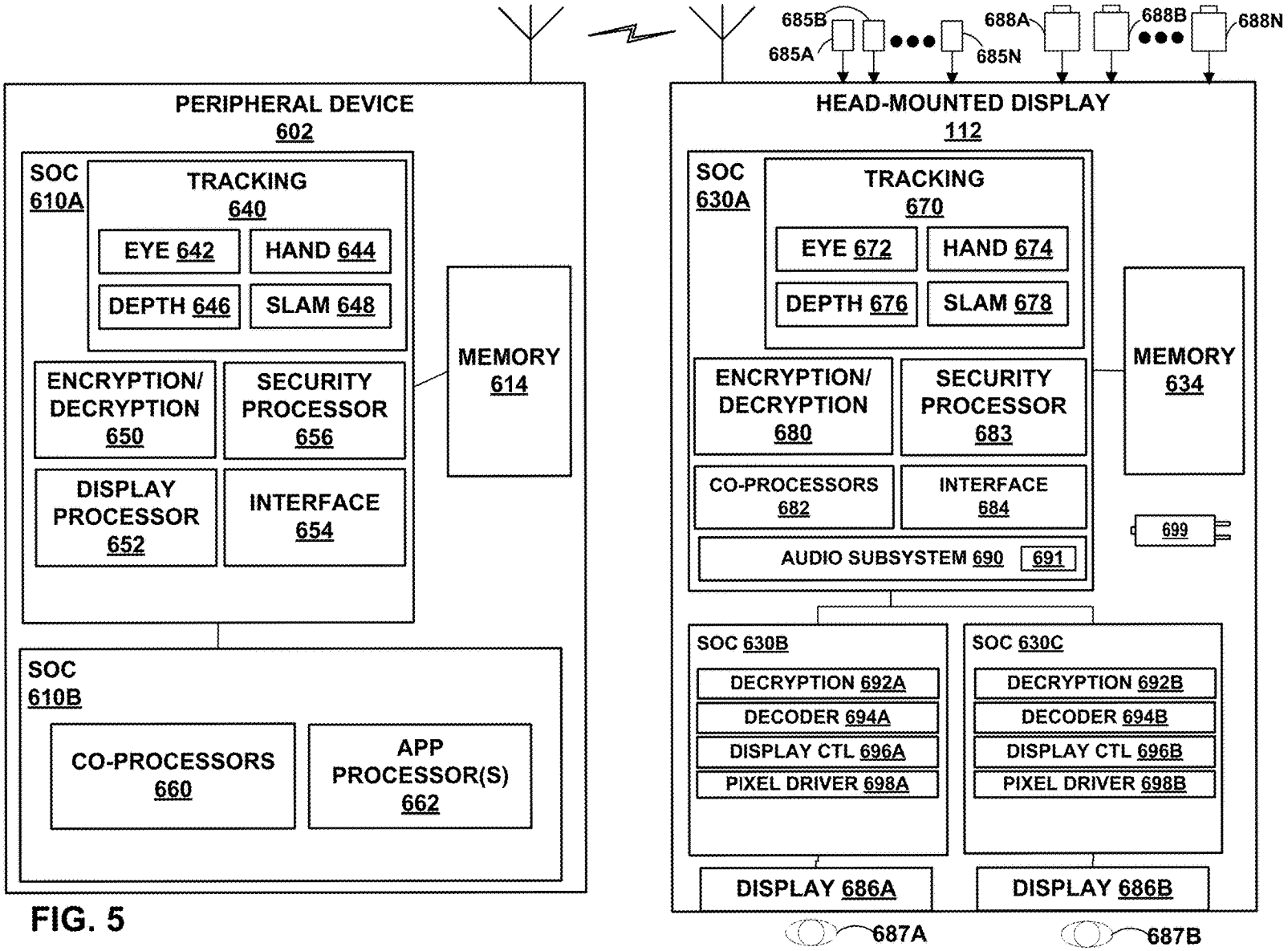
FIG. 5 is a block diagram illustrating a more detailed example implementation of a distributed architecture for a multi-device artificial reality system in which one or more devices are implemented using one or more SoC integrated circuits within each device, in accordance with one or more aspects of the present disclosure.

FIG. 5 is a block diagram illustrating a more detailed example implementation of a distributed architecture for a multi-device artificial reality system in which one or more devices are implemented using one or more SoC integrated circuits within each device, in accordance with one or more aspects of the present disclosure. In some examples, artificial reality system includes a peripheral device 602 operating in conjunction with HMD 112. In this example, peripheral device 602 is a physical, real-world device having a surface on which the AR system may overlay virtual content. Peripheral device 602 may include one or more presence-sensitive surfaces for detecting user inputs by detecting a presence of one or more objects (e.g., fingers, stylus) touching or hovering over locations of the presence-sensitive surface. In some examples, peripheral device 602 may include an output display, which may be a presence-sensitive display. In some examples, peripheral device 602 may be a smartphone, tablet computer, personal data assistant (PDA), or other hand-held device. In some examples, peripheral device 602 may be a smartwatch, smartring, or other wearable device. Peripheral device 602 may also be part of a kiosk or other stationary or mobile system. Peripheral device 602 may or may not include a display device for outputting content to a screen.

In general, the SoCs illustrated in FIG. 5 represent a collection of specialized integrated circuits arranged in a distributed architecture, where each SoC integrated circuit includes various specialized functional blocks configured to provide an operating environment for artificial reality applications. FIG. 5 is merely one example arrangement of SoC integrated circuits. The distributed architecture for a multi-device artificial reality system may include any collection and/or arrangement of SoC integrated circuits.

In this example, SoC 630A of HMD 112 comprises functional blocks including tracking 670, an encryption/decryption 680, co-processors 682, security processor 683, and an interface 684. Tracking 670 provides a functional block for eye tracking 672 ("eye 672"), hand tracking 674 ("hand 674"), depth tracking 676 ("depth 676"), and/or Simultaneous Localization and Mapping (SLAM) 678 ("SLAM 678"). For example, HMD 112 may receive input from one or more accelerometers (also referred to as inertial measurement units or "IMUs") that output data indicative of current acceleration of HMD 112, GPS sensors that output data indicative of a location of HMD 112, radar or sonar that output data indicative of distances of HMD 112 from various objects, or other sensors that provide indications of a location or orientation of HMD 112 or other objects within a physical environment. HMD 112 may receive audio data from one or more audio sensors or microphones 685A-685N (collectively, "microphones 685"). One or more of microphones 685 may correspond to sensors 207 described in connection with FIG. 2A, FIG. 2B, FIG. 3, and FIG. 4. HMD 112 may also receive image data from one or more image capture devices 688A-688N (collectively, "image capture devices 688"). Image capture devices may include video cameras, laser scanners, Doppler radar scanners, depth scanners, or the like, configured to output image data representative of the physical environment. More specifically, image capture devices capture image data representative of objects (including peripheral device 602 and/or hand) in the physical environment that are within a field of view of image capture devices, which typically corresponds with the viewing perspective of HMD 112. Based on the sensed data and/or image data, tracking 670 determines, for example, a current pose for the frame of reference of HMD 112 and, in accordance with the current pose, renders the artificial reality content.

Encryption/decryption 680 is a functional block to encrypt outgoing data communicated to peripheral device 602 or security server and decrypt incoming data communicated from peripheral device 602 or security server. Encryption/decryption 680 may support symmetric key cryptography to encrypt/decrypt data with a session key (e.g., secret symmetric key).

Co-application processors 682 includes various processors such as a video processing unit, graphics processing unit, digital signal processors, encoders and/or decoders, and/or others.

Security processor 683 provides secure device attestation and mutual authentication of HMD 112 when pairing with devices, e.g., peripheral device 606, used in conjunction within the AR environment. Security processor 683 may authenticate SoCs 630A-630C of HMD 112.

Interface 684 is a functional block that includes one or more interfaces for connecting to functional blocks of SoC 630A. As one example, interface 684 may include peripheral component interconnect express (PCIe) slots. SoC 630A may connect with SoC 630B, 630C using interface 684. SoC 630A may connect with a communication device (e.g., radio transmitter) using interface 684 for communicating with other devices, e.g., peripheral device 136.

Audio subsystem 690 may perform operations relating to processing audio samples collected one or more audio sensors or microphones 685. Audio subsystem 690 may correspond to, or include functionality of audio processing system 390 described in connection with FIG. 3 and FIG. 4. Audio subsystem 690 may include a control system 691 (e.g., control logic) that is capable of or configured to selectively transition each of microphones 685 into an enabled or disabled state (e.g., "turn on" or "turn off" microphones 685). In some cases, control system 691 may enable or disable one or more microphones for the purpose of efficiently managing power consumed by HMD 112. In other situations, control system 691 may enable or disable one or more microphones for another purpose. Such a control system 691 may, when enabling a microphone, configure that microphone 685 to operate at one of a plurality of frequencies. In some examples, each of microphones 685 may operate at the same frequency when enabled. In other examples, some microphones 685 may operate at different frequencies than other microphones. Although control system 691 is shown implemented within or located within audio subsystem 690, control system 691 may be located elsewhere within SoC 630A or elsewhere within HMD 112.

Audio subsystem 690 may also include an audio processing system configured to perform techniques, as described herein, to align processing of audio samples collected by microphones 685, particularly in situations where such microphones may be turned on asynchronously, at arbitrary times. Such an audio processing system may further process the resulting aligned audio samples by performing directional alignment, direction of arrival estimation, audio localization, and other procedures.

SoCs 630B and 630C each represents display controllers for outputting artificial reality content on respective displays, e.g., displays 686A, 686B (collectively, "displays 686"). In this example, SoC 630B may include a display controller for display 668A to output artificial reality content for a left eye 687A of a user. For example, SoC 630B includes a decryption block 692A, decoder block 694A, display controller 696A, and/or a pixel driver 698A for outputting artificial reality content on display 686A. Similarly, SoC 630C may include a display controller for display 668B to output artificial reality content for a right eye 687B of the user. For example, SoC 630C includes decryption 692B, decoder 694B, display controller 696B, and/or a pixel driver 698B for generating and outputting artificial reality content on display 686B. Displays 668 may include Light-Emitting Diode (LED) displays, Organic LEDs (OLEDs), Quantum dot LEDs (QLEDs), Electronic paper (E-ink) displays, Liquid Crystal Displays (LCDs), or other types of displays for displaying AR content.

HMD 112 further includes external memory 634, which may be accessible to each of SoCs 630A, 630B, and/or 630C. As illustrated in FIG. 5, HMD 112 includes power source 699, providing power to each of SoCs 630A, 630B, 630C and/or displays 686.

Peripheral device 602 includes SoCs 610A and 610B configured to support an artificial reality application. In this example, SoC 610A comprises functional blocks including tracking 640, an encryption/decryption 650, a display processor 652, an interface 654, and security processor 656. Tracking 640 is a functional block providing eye tracking 642 ("eye 642"), hand tracking 644 ("hand 644"), depth tracking 646 ("depth 646"), and/or Simultaneous Localization and Mapping (SLAM) 648 ("SLAM 648"). For example, peripheral device 602 may receive input from one or more accelerometers (also referred to as inertial measurement units or "IMUs") that output data indicative of current acceleration of peripheral device 602, GPS sensors that output data indicative of a location of peripheral device 602, radar or sonar that output data indicative of distances of peripheral device 602 from various objects, or other sensors that provide indications of a location or orientation of peripheral device 602 or other objects within a physical environment. Peripheral device 602 may in some examples also receive image data from one or more image capture devices, such as video cameras, laser scanners, Doppler radar scanners, depth scanners, or the like, configured to output image data representative of the physical environment. Based on the sensed data and/or image data, tracking block 640 determines, for example, a current pose for the frame of reference of peripheral device 602 and, in accordance with the current pose, renders the artificial reality content to HMD 112.

Encryption/decryption 650 encrypts outgoing data communicated to HMD 112 or security server and decrypts incoming data communicated from HMD 112 or security server. Encryption/decryption 550 may support symmetric key cryptography to encrypt/decrypt data using a session key (e.g., secret symmetric key).

Display processor 652 includes one or more processors such as a video processing unit, graphics processing unit, encoders and/or decoders, and/or others, for rendering artificial reality content to HMD 112.

Interface 654 includes one or more interfaces for connecting to functional blocks of SoC 510A. As one example, interface 684 may include peripheral component interconnect express (PCIe) slots. SoC 610A may connect with SoC 610B using interface 684. SoC 610A may connect with one or more communication devices (e.g., radio transmitter) using interface 684 for communicating with other devices, e.g., HMD 112.

Security processor 656 may provide secure device attestation and mutual authentication of peripheral device 602 when pairing with devices, e.g., HMD 112, used in conjunction within the AR environment. Security processor 656 may authenticate SoCs 610A, 610B of peripheral device 602.

SoC 610B includes co-application processors 660 and application processors 662. In this example, co-application processors 660 includes various processors, such as a vision processing unit (VPU), a graphics processing unit (GPU), and/or central processing unit (CPU). Application processors 662 may include a processing unit for executing one or more artificial reality applications to generate and render, for example, a virtual user interface to a surface of peripheral device 602 and/or to detect gestures performed by a user with respect to peripheral device 602.

In some examples, various components or systems within an overall artificial reality system may operate in a low power mode. For instance, HMD 112, which is shown in the previously described illustrations, may operate or be configured to operate, at times, in a way that reduces use of its internal power source 699. Where power source 699 is a battery, the time during which HMD 112 is able effectively operate using power source 699 can be extended if HMD 112 operates in a way that reduces power consumption.

One way in which HMD 112 may conserve power is to reduce devices, components, and/or peripheral devices that draw power from power source 699. For instance, HMD 112 may, in some examples, disable, turn off, or remove power from one or more microphones 685 in situations in which not all of such microphones 685 are necessary for effective operation of HMD 112 within an overall artificial reality system. In some examples, HMD 112 may operate in a low-power mode by default, and use only a subset of microphones 685, rather than the full array of available microphones 685. By using only a subset of microphones 685, HMD 112 may consume less power in many situations.

In some situations, however, HMD 112 may transition from low power mode to a more robust mode, in which use of additional microphones 685 may be desirable or required for certain operations. For instance, when a user wearing HMD 112 moves from a quiet environment to a noisy environment, an array of microphones 685 may be useful in discerning the user's audio speech from other sounds in the physical environment. In such an example, and in other situations where identifying a source of a sound and/or distinguishing audio sources is useful, HMD 112 may use an array of microphones 685 to analyze audio from multiple microphones 685 and perform sound source identification. Alternatively, or in addition, HMD 112 may use audio captured by multiple microphones 685 to perform directional alignment, direction of arrival estimation, audio localization, and other procedures. Use of more microphones 685, however, consumes more power than using fewer microphones 685, so HMD 112 might only use a larger number of microphones 685 in certain circumstances, such as when required by characteristics of the physical environment (e.g., a noisy environment) or by a particular application executing on HMD 112 or console 106.

To transition to a mode of operation that enables such audio analysis to be performed, HMD 112 may turn on one or more or a series of microphones 685 that were previously off (i.e., previously drawing little or no power). However, asynchronously turning on additional microphones 685 may result in some of microphones 685 capturing audio samples that are not quite aligned with audio samples captured by other microphones 685 in the array. In some situations, such misalignment creates complications when HMD 112 performs certain operations on audio samples (e.g., sound source identification, directional alignment, localization, mixing). Performing such operations tends to be much more efficient or feasible if the audio samples from each of microphones 685 in the array of microphones 685 are aligned.

Therefore, in the example of FIG. 5, and in accordance with one or more aspects of the present disclosure, HMD 112 may align audio samples received from multiple microphones 685. For instance, in an example that can be described with reference to FIG. 5, processors 682 receive an indication that HMD 112 is operating in a mode in which multiple microphones 685 may be desired or necessary. Processors 682 cause additional microphones 685 within an array of microphones 685 to turn on. Processors 682 cause audio samples from such microphones 685 to stream to audio subsystem 690. Audio subsystem 690 receives audio samples from multiple microphones 685, some of which may have been started or turned on at different times. Audio subsystem 690 aligns the processing of audio samples received from each of microphones 685.

In some examples, to align the processing of samples, audio subsystem 690 may introduce a delay into the processing of audio samples being received from one or more microphones 685 (e.g., later-turned on microphones 685). In other examples, audio subsystem 690 may use a synchronization signal to process each of the audio samples. In such an example, audio subsystem 690 uses the synchronization signal to synchronize the time at which audio processing pipelines associated with each of the audio samples captured by microphones 685 is started. For audio processing pipelines associated with an audio sample, some audio processing data received prior to an initial synchronization signal may be discarded.

Figure 6A:
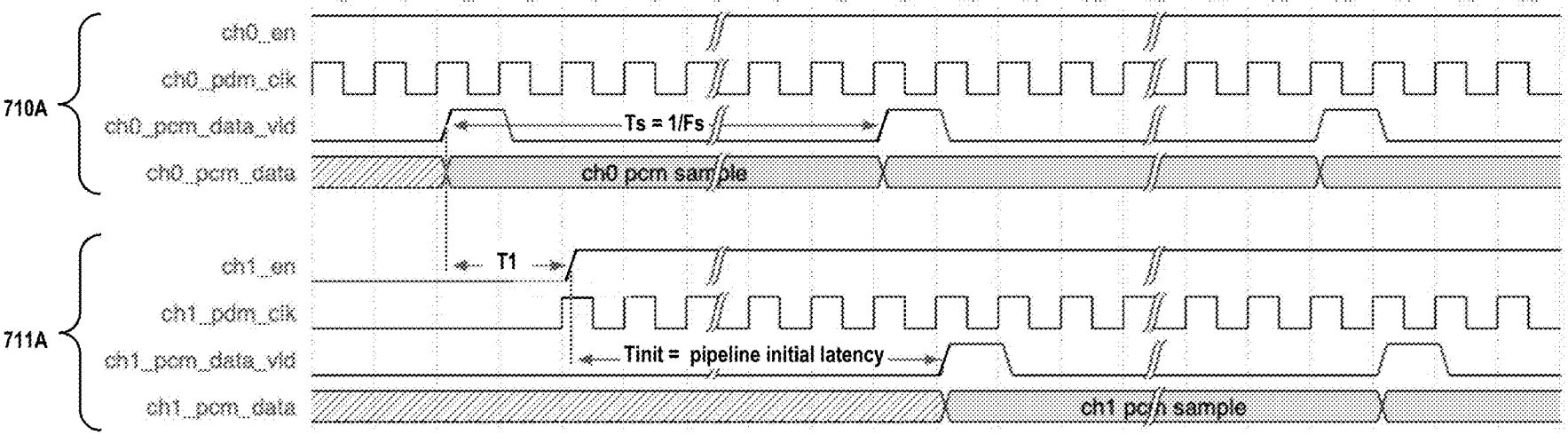
FIG. 6A, FIG. 6B, and FIG. 6C are timing diagrams illustrating processing of audio samples collected from multiple microphones, in accordance with one or more aspects of the present disclosure.
Figure 6B:
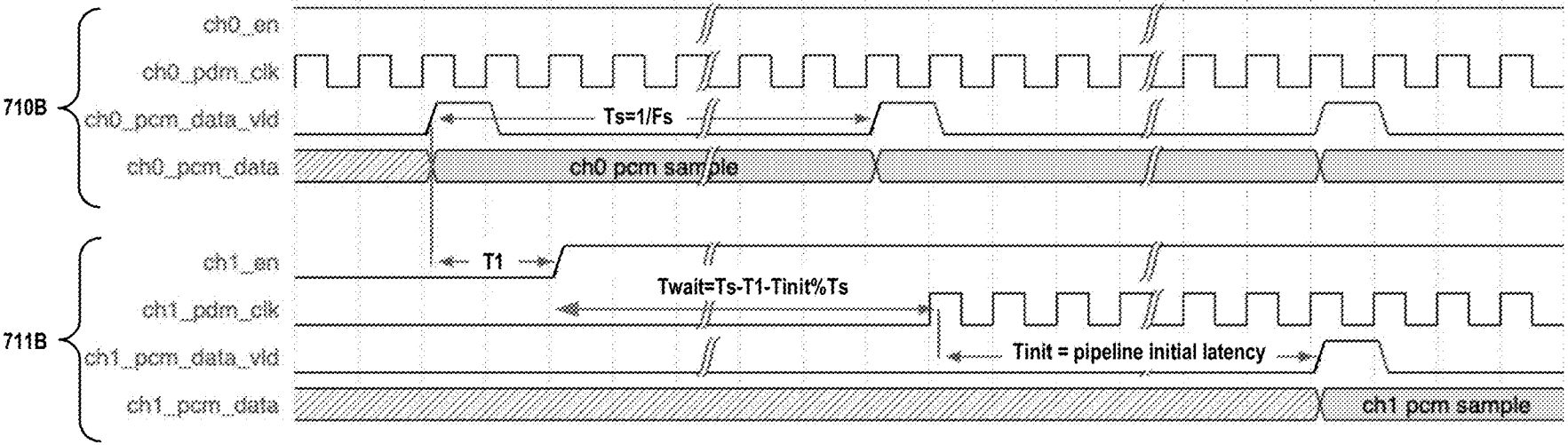
Figure 6C:
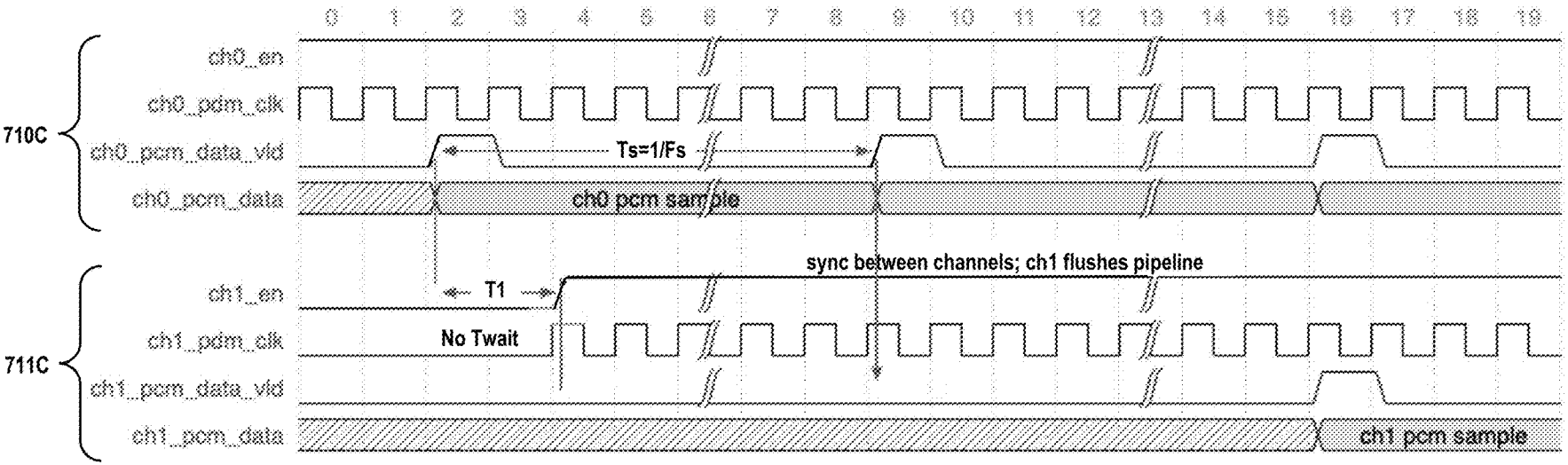

FIG. 6A, FIG. 6B, and FIG. 6C are timing diagrams illustrating processing of audio samples collected from multiple microphones, in accordance with one or more aspects of the present disclosure. Each of FIG. 6A, FIG. 6B, and FIG. 6C include two sets of waveforms (i.e., channel 0 and channel 1), each having a channel enable signal (e.g., "ch0_en"), a pulse density modulation (PDM) clock (e.g., "ch0_pdm_clk"), a pulse code modulation (PCM) data valid signal (e.g., "ch0_pcm_data_vld"), and a PCM data waveform (e.g., "ch0_pcm_data"). In each of FIG. 6A, FIG. 6B, and FIG. 6C, channels 0 and 1 operate at the same sampling frequency. Further, in each of FIG. 6A, FIG. 6B, and FIG. 6C, the microphone associated with channel 1 is turned on after the microphone associated with channel 0. The audio samples collected and depicted in the waveforms of FIG. 6A, FIG. 6B, and FIG. 6C may correspond to audio samples collected by, for example, two of the microphones 685 of FIG. 5.

In FIG. 6A, channel 0 timing diagram 710A and channel 1 timing diagram 711A illustrate operations performed by audio subsystem 690 in processing audio data from two channels. Channel 0 timing diagram 710A corresponds to processing of audio data from one of microphones 685. Channel 1 timing diagram 711A corresponds to processing of audio data from a different one of microphones 685. In the example shown, the microphone corresponding to channel 1 timing diagram 711A is turned on or enabled (i.e., when "ch1_en" is raised) at a time when the microphone corresponding to channel 0 timing diagram 710A is already on or enabled. Accordingly, audio subsystem 690 is already processing audio data for the microphone corresponding to channel 0 timing diagram 710A when audio subsystem 690 starts processing data from the microphone corresponding to channel 1 timing diagram 711A. In some examples, audio subsystem 690 may process audio data in a multi-stage processing pipeline that requires multiple clock cycles. If audio subsystem 690 starts processing audio data in channel 1 when audio subsystem 690 has already started processing audio data in channel 0, the data valid signals for each of channel 0 timing diagram 710A and channel 1 timing diagram 711A might not be aligned.

Such a misalignment is illustrated in FIG. 6A. In FIG. 6A, channel 0 begins processing audio data samples periodically, including at clock cycles 2, 9, 16 as illustrated in FIG. 6A. The pipeline period is labeled in FIG. 6A as Ts (i.e., 1/frequency of the clock). If channel 1 is enabled at some arbitrary time (e.g., at clock cycle 4), there is a time period T1 that represents the amount of time that the processing for the audio pipeline for channel 1 lags that of channel 0. The data valid signal for channel 1 ("ch1_pcm_data_vld") then is triggered after the initial pipeline latency, Tinit, such that the data is valid in for channel 1 at clock 10, and then periodically. In the example shown, even if the pipeline latency is the same for both channels 0 and 1, the data valid signals are not synchronized, because the audio processing pipelines start on different clock cycles.

Processing audio data samples generated by audio processing pipelines where the data valid signals are not generated at the same time tends to complicate some types of multi-sample processing, such as sound source identification, localization, mixing, and other operations. In accordance with one or more aspects of the present disclosure, techniques are described herein for aligning the phase of audio processing pipelines in a manner that enables data valid signals for each processing pipeline to be generated in a synchronized manner. Such alignment simplifies, and in some cases may make feasible, some types of processing on multiple samples of audio data.

In FIG. 6B, channel 0 timing diagram 710B and channel 1 timing diagram 711B illustrate operations performed by audio subsystem 690 to align processing of audio samples for multiple channels. As in FIG. 6A, channel 0 timing diagram 710B corresponds to processing of audio data from one of microphones 685, and channel 1 timing diagram 711B corresponds to processing of audio data from a different one of microphones 685. In the example of FIG. 6B, the microphone corresponding to channel 1 timing diagram 711B is turned on after the microphone corresponding to channel 0 timing diagram 710B. Specifically, the channel 1 microphone is turned on at a time of T1 after channel 0 starts a processing pipeline for audio data captured by channel 0.

In accordance with one or more aspects of the present disclosure, and to ensure that the audio samples received from each of the two microphones are processed at the same time in the example illustrated in FIG. 6B, audio subsystem 690 introduces a delay before activating the clock ("ch1_pdm_clk") for channel 1. This delay (T wait in FIG. 6B) ensures that the audio processing pipelines for channels 0 and 1 start at the same time, which has the effect of ensuring that the data valid signal for channel 1 occurs at the same time as the data valid signal for channel 0. In some examples, audio subsystem 690 calculates the delay by subtracting T1 from the length of the period of the audio processing pipeline. T1 can be known, since audio subsystem 690 may monitor data valid signals generated by channel 0, and since they are periodic, it is possible to know, at any given clock cycle, how many clock cycles since the last processing pipeline for channel 0 was initiated (or equivalently, how many clock cycles until the next processing pipeline for channel 0 will be started). Accordingly, a delay is introduced to ensure that channel 1 starts its processing pipeline at the same time that channel 0 starts its processing pipeline. The result, as illustrated in FIG. 6B, is that the data valid signals for both channels occur on the same clock cycle. By ensuring that the data valid signal for channel 1 occurs at the same time as the data valid signal for channel 0, the processed data samples for each of channels 0 and 1 will be aligned. Audio subsystem 690 may use such aligned data samples to perform sound source identification, localization, mixing, and other operations.

In FIG. 6C, channel 0 timing diagram 710C and channel 1 timing diagram 711C illustrate alternative example operations performed by audio subsystem 690 to align processing of audio samples for multiple channels. As in FIG. 6A and FIG. 6B, channel 0 timing diagram 710C corresponds to processing of audio data from one of microphones 685, and channel 1 timing diagram 711C corresponds to processing of audio data from another one of microphones 685, and the microphone corresponding to channel 1 is turned on after the microphone corresponding to channel 0.

In accordance with one or more aspects of the present disclosure, and to ensure that the same audio samples are processed at the same time in the example of FIG. 6C, audio subsystem 690 uses a synchronization signal communicated between channels to ensure that the data valid signal for channel 1 occurs at the same time as the data valid signal for channel 0. In the example of FIG. 6C, audio subsystem 690 may generate a synchronization signal each time the data valid signal is generated for channel 0. At each synchronization signal, audio subsystem 690 ensures that channel 1 starts its audio processing pipeline at that clock cycle. In such an example, channel 1 may receive a synchronization signal before it is ready to generate a valid audio sample. Such a situation will typically arise when channel 1 is turned on after channel 0 has already started its last processing pipeline, and channel 1 thus has not completed its own processing pipeline. In such a situation, and in the example illustrated in FIG. 6C, channel 1 abandons its incomplete processing pipeline, and starts a new processing pipeline. In some examples, audio subsystem 690 may discard any partially processed pipeline data for channel 1 by flushing buffers associated with channel 1 processing ("ch1 flushes pipeline"). When the next and subsequent synchronization signals are received, both channel 0 and channel 1 will be synchronized, and will be completing (or will have completed) their respective processing pipelines. In the example of FIG. 6C, it might not be necessary to calculate "T1" or calculate "Twait" (indicating how long to wait until starting a processing pipeline), since the synchronization signal may provide all necessary information.

Figure 7A:
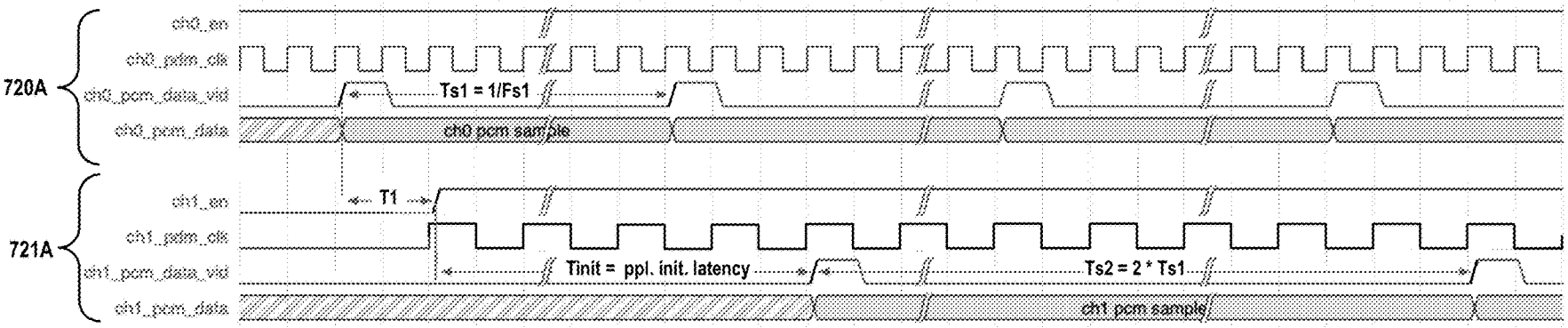
FIG. 7A, FIG. 7B, and FIG. 7C are timing diagrams illustrating processing of audio samples collected from multiple microphones operating at different sampling frequencies, in accordance with one or more aspects of the present disclosure.
Figure 7B:
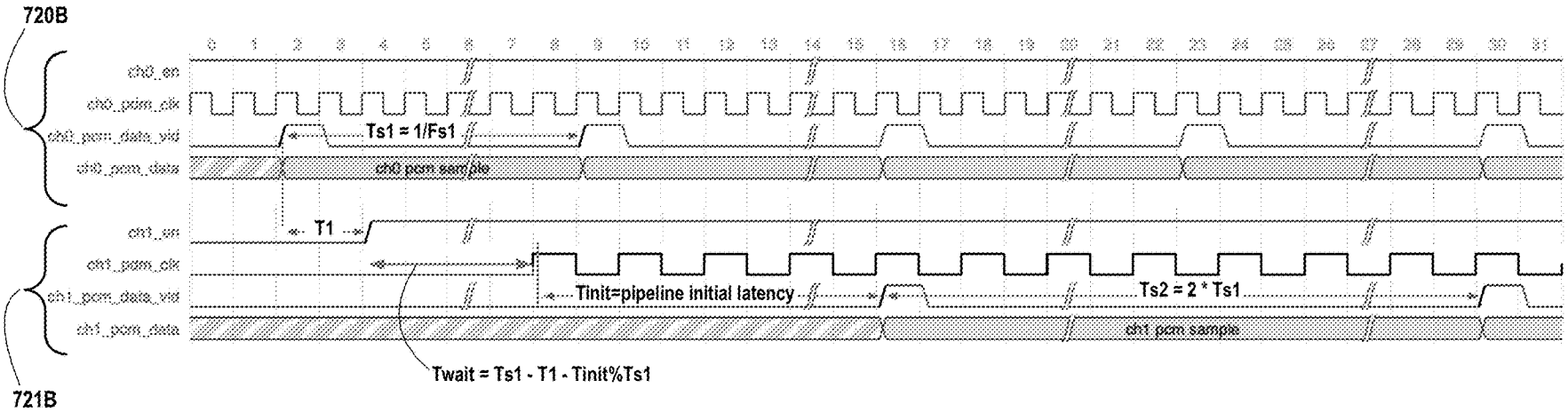
Figure 7C:
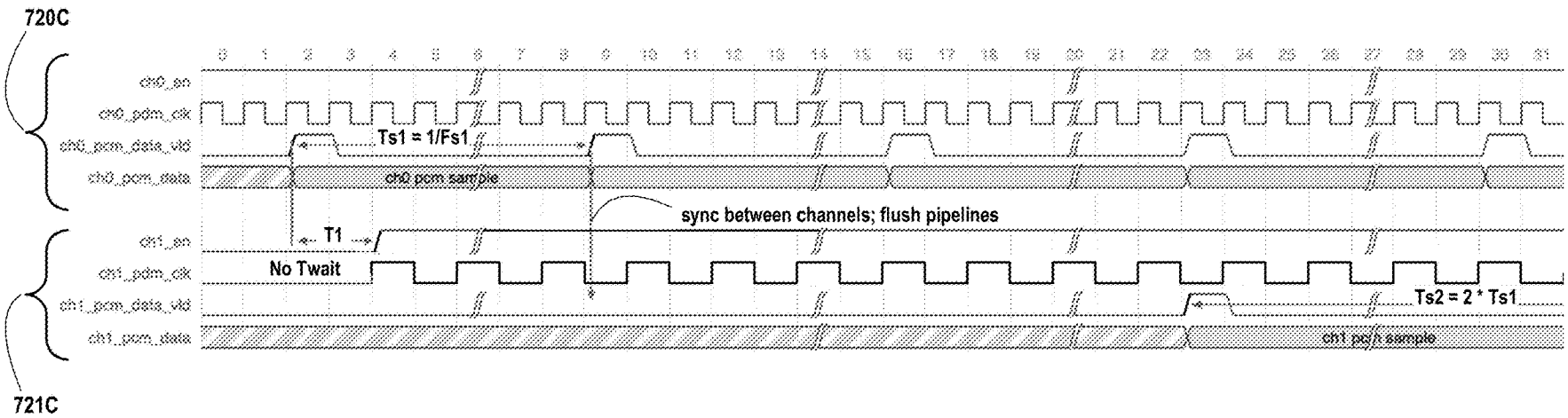

FIG. 7A, FIG. 7B, and FIG. 7C are timing diagrams illustrating processing of audio samples collected from multiple microphones operating at different sampling frequencies, in accordance with one or more aspects of the present disclosure. As in FIG. 6A, FIG. 6B, and FIG. 6C, each of FIG. 7A, FIG. 7B, and FIG. 7C include two sets of waveforms (i.e., channel 0 and channel 1), each having a channel enable signal (e.g., "ch0 en"), a pulse density modulation (PDM) clock (e.g., "ch0_pdm_clk"), a pulse code modulation (PCM) data valid signal (e.g., "ch0_pcm_data_vld"), and a PCM data waveform (e.g., "ch0_pcm_data"). In each of FIG. 7A, FIG. 7B, and FIG.

7C, the microphone associated with channel 1 is turned on after the microphone associated with channel 0. In the examples illustrated, channel 0 operates at a higher frequency than channel 1 (e.g., 32 KHz and 16 KHz). In other examples, however, channel 1 may operate at a higher frequency than channel 0, which may correspond to a scenario in which a higher-fidelity microphone is being added to a microphone array (e.g., such as in a situation where HMD 112 seeks to move to a more robust audio processing mode). However, a scenario in which a lower-fidelity microphone is being added to a microphone array is a valid use case in some examples, at least since it may be used when transitioning to modes requiring a less robust audio processing mode, as further described in connection with FIG. 8.

In FIG. 7A, channel 0 timing diagram 720A and channel 1 timing diagram 721A illustrate operations performed by audio subsystem 690 in processing audio data from two channels operating at a different frequency. In the example shown in FIG. 7A, since the microphone corresponding to channel 1 is turned on after the microphone corresponding to channel 0, audio subsystem 690 is already processing audio data sampled by the microphone corresponding to channel when audio subsystem 690 starts processing audio data sampled by the microphone for channel 1. Accordingly, FIG. 7A illustrates that if audio subsystem 690 starts processing audio data in channel 1 when audio subsystem 690 has already started processing audio data in channel 0 timing diagram 720A, the data valid signals for each of channel 0 and channel 1 might not be aligned. The misalignment may be exacerbated in the example of FIG. 7A by the differing frequencies at which channels 0 and 1 operate. As in FIG. 6A, such misalignment may complicate some types of multi-sample processing, such as sound source identification, localization, mixing, and other operations.

In FIG. 7B, channel 0 timing diagram 720B and channel 1 timing diagram 721B illustrate operations performed by audio subsystem 690 to align processing of audio samples for multiple channels when those channels operate at different frequencies. In the example of FIG. 7B, the microphone corresponding to channel 1 is turned on after the microphone corresponding to channel 0. Specifically, the channel 1 microphone is turned a period of time ("T1") after channel 0 starts a processing pipeline. In a manner similar to that described in connection with FIG. 6B, and to ensure that the same audio samples are processed at the same time in the example of FIG. 7B, audio subsystem 690 introduces a delay before activating the clock for channel 1. The delay (i.e., "Twait") ensures that the data valid signal for channel 1 occurs at a time that aligns with the frequency of channel 0. In the example shown, audio subsystem 690 introduces the delay into channel 1 so that the data valid signals for each of channel 0 and 1 will be aligned in their natural beats (i.e., at each data valid signal for channel 1, and at every other data valid signal for channel 0). In some examples, audio subsystem 690 calculates the delay ("Twait") by subtracting T1 from the period of channel 1 ("Ts2"). As noted in FIG. 7B, Ts2 is twice "Ts1," which is the period of channel 0. As also noted in FIG. 7B, calculating Twait also may include further subtracting the modulus of Tinit and Ts1 (i.e., the number of clock cycles in the remainder after division of Tinit by Ts1).

In FIG. 7C, channel 0 timing diagram 720C and channel 1 timing diagram 721C illustrate an alternative example of operations performed by audio subsystem 690 to align processing of audio samples for multiple channels that are operating at different frequencies. In this example, to ensure that the same audio samples are processed at the same time, audio subsystem 690 uses a synchronization signal communicated between channels to ensure that a data valid signal for channel 0 timing diagram 720C occurs at the same time as the data valid signal for channel 1 timing diagram 721C. Specifically, audio subsystem 690 ensures that every other data valid signal for channel 0 timing diagram 720C occurs at the same time as a data valid signal for channel 1 timing diagram 721C. In the example of FIG. 6C, audio subsystem 690 may generate a synchronization signal every other time that a data valid signal is generated for channel 0. In FIG. 7A, the frequency at which channel 0 operates is twice that of channel 1. In a different examples, such as an example where the frequency of channel 0 is three times that of channel 1, audio subsystem 690 may generate a synchronization signal every third time that a data valid signal is generated for channel 0.

In the example of FIG. 7C, where a synchronization signal is generated every other time that a data valid signal is generated for channel 0, audio subsystem 690 ensures that channel 1 starts its audio processing pipeline at each such synchronization signal. In such an example, and as in FIG. 6C, channel 1 may receive a synchronization signal before it is ready to generate a valid audio sample (e.g., if channel 1 was turned on after channel 0 started its last processing pipeline, and channel 1 has not completed its own processing pipeline). In such a situation, and in an example corresponding to that of FIG. 7C, channel 1 may abandon its incomplete processing pipeline and start a new processing pipeline, thereby ensuring that it starts a processing pipeline for audio data at the same time as channel 0. Audio subsystem 690 may, in some examples, discard any partially processed pipeline data for channel 1 by flushing buffers associated with channel 1 processing.

Figure 8:
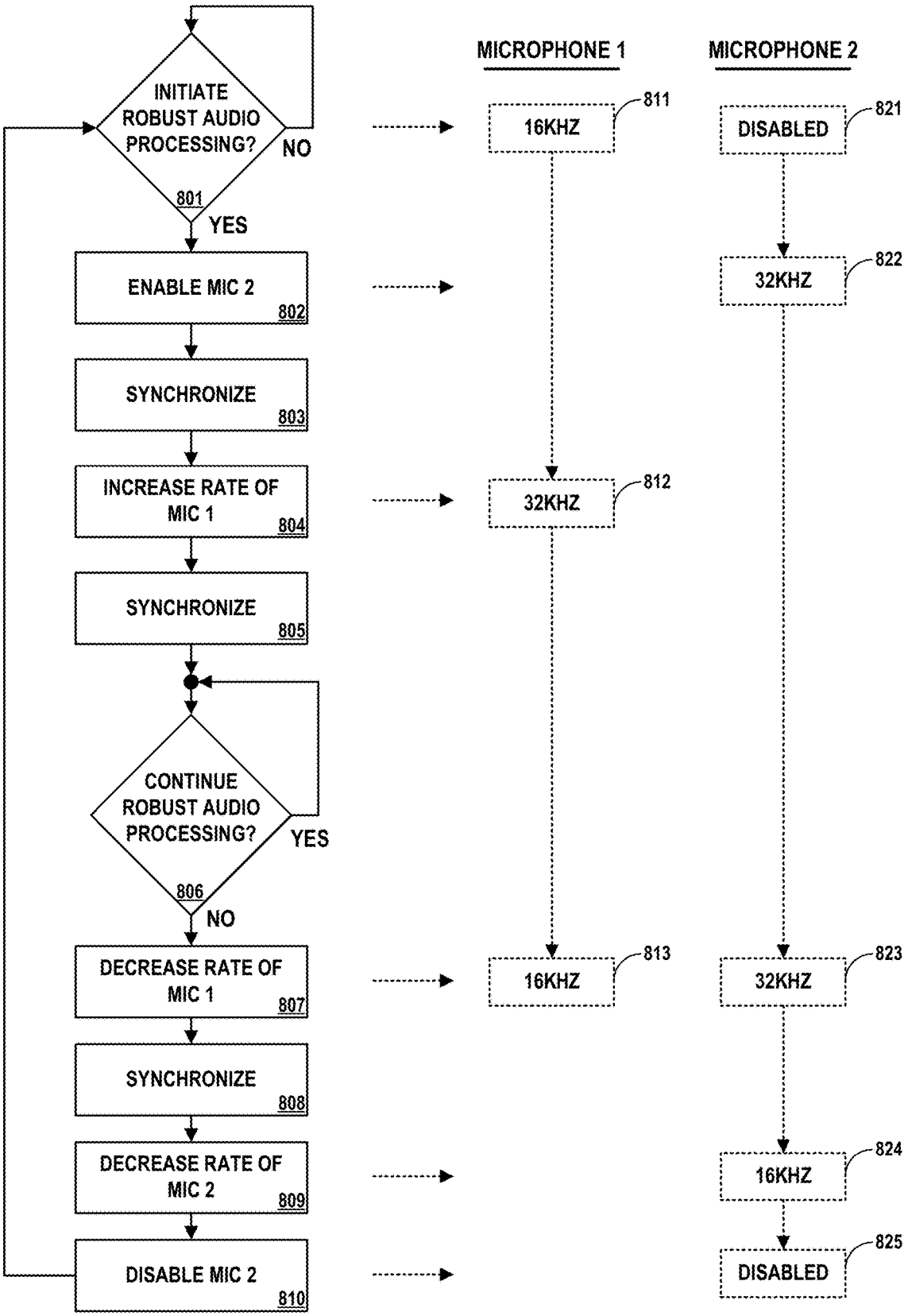
FIG. 8 is a flow diagram illustrating an example process for transitioning between audio processing states in accordance with one or more aspects of the present disclosure.

FIG. 8 is a flow diagram illustrating an example process for transitioning between audio processing states in accordance with one or more aspects of the present disclosure. The process of FIG. 8 is described herein within the context of audio subsystem 690 within HMD 112 of FIG. 5 transitioning from a low-power, less-robust audio processing mode, into a higher power consumption, more robust audio processing mode, and then back again to a low-power, less robust audio processing mode. For ease of illustration and to simplify the description, the example of FIG. 8 is described in the context of two microphones, which may correspond to any two of microphones 685 illustrated in FIG. 5. The example of FIG. 8 can, however, be extended to any number of microphones. Further, in other examples, different operations may be performed, or operations described in FIG. 8 as being performed by a particular component, module, system, and/or device may be performed by one or more other components, modules, systems, and/or devices. Further, in other examples, operations described in connection with FIG. 8 may be performed in a difference sequence, merged, omitted, or may encompass additional operations not specifically illustrated or described even where such operations are shown performed by more than one component, module, system, and/or device.

In the process illustrated in FIG. 8, and in accordance with one or more aspects of the present disclosure, audio subsystem 690 may initially operate in a relatively low-power mode, characterized in the example of FIG. 8 as a mode where microphone 1 is enabled and operating at a frequency of 16 KHz (811), and where microphone 2 is disabled, and likely drawing little or no power (821).

HMD 112 may determine that a more robust audio processing mode may be appropriate (YES path from 801).

For instance, in the example of FIG. 8, HMD 112 may detect input that HMD 112 determines corresponds to initiation of an application that requires more robust audio processing. In another example, one or more microphones 685 of HMD 112 may detect input that HMD 112 determines corresponds to an indication that the physical environment in which HMD 112 operates has changed from a relatively quiet environment into a noisy one, where multiple microphones may be required to accurately discern a user's voice or to effectively perform sufficient direction of arrival estimation or other processing. Other circumstances may, in other situations, cause HMD 112 to determine that a more robust audio processing mode may be appropriate.

HMD 112 may enable an additional microphone (802). For instance, in the example of FIG. 8, HMD 112 causes a control system within audio subsystem 690 to enable microphone 2 at a frequency of 32 KHz (822). Microphone 2 may be enabled at any arbitrary time, so the processing of audio samples collected by microphones 1 and 2 is likely going to be misaligned as described in connection with FIG. 6A and FIG. 7A.

After enabling microphone 2, HMD 112 may synchronize the audio processing of the samples collected by microphones 1 and 2 (803). For instance, in the example of FIG. 8, audio subsystem 690 may introduce a delay into the audio processing pipeline associated with microphone 2 to ensure that the audio processing of microphone 2 is aligned with the audio processing of microphone 1. Since microphone 2 operates at a different frequency than that of microphone 1, audio subsystem 690 may perform techniques analogous to those described in connection with FIG. 7B to properly calculate the delay to be introduced into the pipeline associated with microphone 2. In another example, audio subsystem 690 may use a synchronization signal triggered by processing associated with microphone 1 to identify an appropriate time to start the audio processing pipeline associated with microphone 2.

HMD 112 may increase the sampling frequency of microphone 1 (804). For instance, in transitioning to a more robust audio processing mode, HMD 112 may determine that both microphones 1 and 2 should operate at 32 KHz. Thus, HMD 112 determines that microphone 1 should be transitioned from operating at a frequency of 16 KHz to a frequency of 32 KHz. In some examples, to transition microphone 1 to a frequency of 32 KHz, audio subsystem 690 may first turn off or disable microphone 1, and reenable microphone 1 at the higher 32 KHz rate (812).

After increasing the rate of microphone 1, HMD 112 may synchronize the audio processing of the samples collected by microphones 1 and 2 (805). In an example where microphone 1 is transitioned from 16 KHz to 32 KHz by first disabling microphone 1 and then reenabling microphone 1 at the higher frequency, audio subsystem 690 may need to align the processing of microphones 1 and 2, since such an example again involves a microphone (in this case, microphone 1) being enabled at an arbitrary time after an existing microphone is already processing audio data. Audio subsystem 690 may align the audio processing of the microphones by introducing a delay, by using a synchronization signal generated by logic associated with the processing of audio data collected by microphone 2, or by using another technique.

When both microphones 1 and 2 are enabled and operating at 32 KHz, the two-microphone system being described in connection with FIG. 8 may be considered to be operating in a robust mode. The 32 KHz frequency at which both microphone 1 and microphone 2 are operating is more robust, since the higher frequency sampling rates enable collection of higher-fidelity audio data. In addition, two microphones may enable processing of audio data that might not be possible with only a single microphone (e.g., sound source identification). However, two microphones operating at 32 KHz consume more power than the less robust initial mode described above characterized by the single 16 KHz microphone 1 (e.g., 811 and 821).

HMD 112 may continue to operate in the more robust audio processing mode (YES path from 806). HMD 112 may alternatively, however, detect that the more robust audio processing mode is no longer necessary (NO path from 806). For instance, in some examples, HMD 112 may determine that the application requiring more robust audio processing is no longer being used, or HMD 112 may detect changes in the physical environment.

HMD 112 may decrease the sampling frequency of microphone 1 (807). For instance, in transitioning to a less robust audio processing mode, HMD 112 may determine that microphone 1 should operate at 16 KHz. In some examples, to transition microphone 1 to 16 KHz, audio subsystem 690 may first disable microphone 1 (currently operating at 32 KHz) and reenable microphone 1 at 16 KHz (813).

After decreasing the rate of microphone 1, HMD 112 may synchronize the audio processing of the samples collected by microphones 1 and 2 (808). In an example where microphone 1 is transitioned from 32 KHz to 16 KHz by first disabling microphone 1 and then reenabling microphone 1 at the lower frequency, alignment of audio data samples being processed by microphones 1 and 2 may be necessary as described in connection with FIG. 7A. To perform such alignment, audio subsystem 690 may introduce a delay into the audio processing pipeline of microphone 1 in the manner described in connection with FIG. 7B. Alternatively, audio subsystem 690 may use a synchronization signal generated by logic associated with the processing of audio data collected by microphone 2, in the manner described in connection with FIG. 7C.

HMD 112 may decrease the sampling frequency of microphone 2 (809). For instance, in transitioning to the less robust audio processing mode, HMD 112 may determine that microphone 2 should operate at 16 KHz (824). HMD 112 may cause audio subsystem 690 to disable microphone 2 and reenable microphone at 16 KHz. After reenabling microphone 2 at 16 KHz, audio subsystem 690 may again align the audio processing of microphones 1 and 2, and then may disable microphone 2 (810 and 825). In the example described, when transitioning to the less robust audio processing mode (806 to 809), audio subsystem 690 transitions microphone 2 from 32 KHz to 16 KHz before disabling microphone 2. Such a process may provide a more graceful and seamless transition from the more robust audio processing mode to the less robust audio processing mode than an alternative process that may involve simply disabling microphone 2 when it is operating at 32 KHz.

Figure 9:
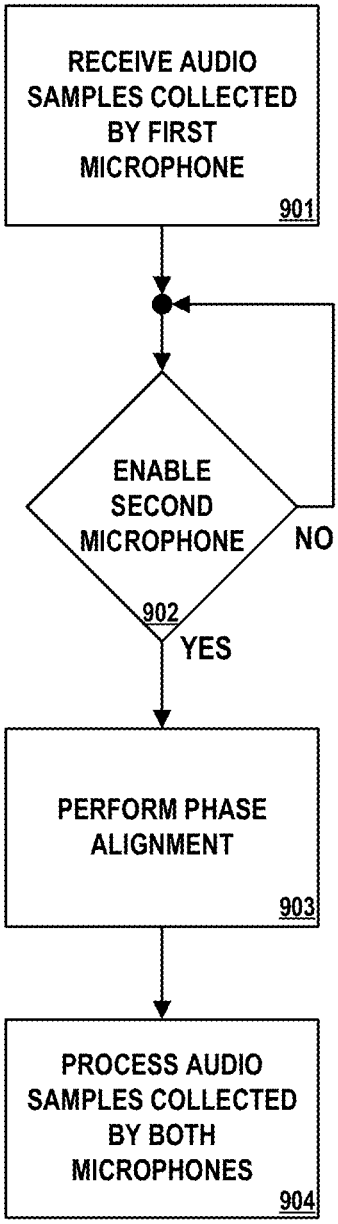
FIG. 9 is a flow diagram illustrating operations performed by an example HMD in accordance with one or more aspects of the present disclosure.

FIG. 9 is a flow diagram illustrating operations performed by an example HMD in accordance with one or more aspects of the present disclosure. FIG. 9 is described below within the context of HMD 112 of FIG. 5. In other examples, operations described in FIG. 9 may be performed by one or more other components, modules, systems, or devices. Further, in other examples, operations described in connection with FIG. 9 may be merged, performed in a difference sequence, omitted, or may encompass additional operations not specifically illustrated or described.

In the process illustrated in FIG. 9, and in accordance with one or more aspects of the present disclosure, HMD 112 may receive audio samples collected by a first microphone (901). For example, in an example that can be described with reference to FIG. 5, microphone 685A detects input and outputs information about the input to SoC 630A. Audio subsystem 690 within SoC 630A receives the information about the input and determines that the input corresponds to audio data samples collected by microphone 685A.

HMD 112 may continue to receive audio samples collected by the first microphone (NO path from 902). Eventually, HMD 112 may determine that a second microphone should be enabled (YES path from 902). For instance, in the example being described with reference to FIG. 5, HMD 112 may detect input that it determines corresponds to a mode change (e.g., a change in the physical environment or a new application being initiated on HMD 112). HMD 112 may further determine that the mode change requires a more robust audio processing system. In such an example, HMD 112 outputs information about the mode change to audio subsystem 690. Audio subsystem 690 causes HMD 112 to enable microphone 685B. Once enabled, microphone 685B detects input and outputs information about the input to audio subsystem 690 within SoC 630A. Audio subsystem 690 determines that the input corresponds to audio data samples collected by microphone 685B.

HMD 112 may perform phase alignment on audio samples collected by the first and second microphones (903). For instance, audio subsystem 690 of HMD 112 may perform a phase alignment procedure to the processing of the audio data samples collected by microphone 685A and microphone 685B. By performing such a procedure, audio subsystem 690 may ensure that the data valid signals, for each processing pipeline corresponding to microphones 685A and 685B, occur on the same clock cycle. To perform such a procedure, audio subsystem 690 may perform operations similar to those described in connection with FIG. 6B, FIG. 6C, FIG. 7B, and/or FIG. 7C.

HMD 112 may process the audio samples collected by the first and second microphones (904). For instance, audio subsystem 690 may use the synchronized audio data from microphones 685A and 685B to perform other operations, including sound source identification, directional alignment, localization, and/or mixing of the audio data.

The techniques described in this disclosure may be implemented, at least in part, in hardware, software, firmware or any combination thereof. For example, various aspects of the described techniques may be implemented within one or more processors, including one or more microprocessors, DSPs, application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit comprising hardware may also perform one or more of the techniques of this disclosure.

Such hardware, software, and firmware may be implemented within the same device or within separate devices to support the various operations and functions described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units may be performed by separate hardware or software components or integrated within common or separate hardware or software components.

The techniques described in this disclosure may also be embodied or encoded in a computer-readable medium, such as a computer-readable storage medium, containing instructions. Instructions embedded or encoded in a computer-readable storage medium may cause a programmable processor, or other processor, to perform the method, e.g., when the instructions are executed. Computer readable storage media may include random access memory (RAM), read only memory (ROM), programmable read only memory (PROM), erasable programmable read only memory (EPROM), electronically erasable programmable read only memory (EEPROM), flash memory, a hard disk, a CD-ROM, a floppy disk, a cassette, magnetic media, optical media, or other computer readable media.

As described by way of various examples herein, the techniques of the disclosure may include or be implemented in conjunction with an artificial reality system. As described, artificial reality is a form of reality that has been adjusted in some manner before presentation to a user, which may include, e.g., a virtual reality VR, an augmented reality AR, a mixed reality MR, a hybrid reality, or some combination and/or derivatives thereof. Artificial reality content may include completely generated content or generated content combined with captured content (e.g., real-world photographs). The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may be associated with applications, products, accessories, services, or some combination thereof, that are, e.g., used to create content in an artificial reality and/or used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

What is claimed is:

1. A system comprising:

a plurality of microphones, including a first microphone and second microphone;

a control system configured to selectively transition the second microphone between an enabled state and a disabled state; and an audio processing system configured to detect a transition by the second microphone from the disabled state to the enabled state, and responsive to detecting the transition, perform phase alignment between audio samples collected by the first microphone and audio samples collected by the second microphone and perform sound source identification using the phase aligned audio samples.

2. The system of claim 1, wherein the system is an artificial reality system, and wherein control system is configured to:

detect a status change associated with the artificial reality system requiring a more robust audio processing; and responsive to detecting the status change, transition the second microphone from the disabled state to the enabled state.

3. The artificial reality system of claim 2, wherein the status change is a first status change, and wherein the audio processing system is further configured to:

detect a second status change associated with the artificial reality system;

determine that the second status change requires less robust audio processing; and responsive to detecting the second status change, enter a low-power mode, wherein to enter the low power mode, the audio processing system is further configured to transition the second microphone from the disabled state to the enabled state.

4. The system of claim 1, wherein the system further includes a head-mounted display (HMD), and wherein the HMD is configured to perform at least one of:

detect input;

detect a change in a mode of the system;

detect audio data associated with a plurality of voices;

detect a transition to a noisier physical environment; and detect a change in the physical environment.

5. A system comprising:

a plurality of microphones, including a first microphone and second microphone;

a control system configured to selectively transition the second microphone between an enabled state and a disabled state; and an audio processing system configured to detect a transition by the second microphone from the disabled state to the enabled state, and responsive to detecting the transition, perform phase alignment between audio samples collected by the first microphone and audio samples collected by the second microphone and process the phase aligned audio samples, wherein the audio processing system is further configured to:

process the audio samples collected by the first microphone using a first pipeline, wherein the first pipeline starts periodically at each of a plurality of starting clock cycles; and process the audio samples collected by the second microphone using a second pipeline.

6. The system of claim 5, wherein to perform phase alignment, the audio processing system is further configured to:

start the second pipeline during each of the plurality of starting clock cycles.

7. The system of claim 6, wherein to start the second pipeline during each of the plurality of starting clock cycles, the audio processing system is further configured to:

introduce a delay in starting the second pipeline after detecting the transition by the second microphone from the disabled state to the enabled state, wherein the delay is calculated based on the length of the first pipeline and an amount of time until one of the starting clock cycles.

8. The system of claim 7, wherein the first pipeline operates at a first sampling frequency, wherein the second pipeline operates at a second sampling frequency that is different than the first sampling frequency, and wherein to introduce the delay in starting the second pipeline, the audio processing system is further configured to:

calculate the delay further based on the difference between the first sampling frequency and the second sampling frequency.

9. The system of claim 8, wherein the second sampling frequency is higher than the first sampling frequency.

10. The system of claim 6, wherein to start the second pipeline during each of the plurality of starting clock cycles, the audio processing system is further configured to:

detect a synchronization signal associated with the plurality of starting clock cycles; and upon detecting the synchronization signal, start the second pipeline.

11. The system of claim 10, wherein the first pipeline operates at a first sampling frequency, and wherein the second pipeline operates at a second sampling frequency that is different than the first sampling frequency, and wherein to start the second pipeline, the audio processing system is further configured to:

generate, prior detecting the synchronization signal, second pipeline data by processing audio samples collected by the second microphone prior to detecting the synchronization signal; and upon detecting the synchronization signal, discarding at least some of the second pipeline data.

12. The system of claim 5, wherein to process the phase aligned audio samples, the audio processing system is further configured to perform at least one of:

sound source identification, directional alignment, localization, mixing.

13. A method comprising:

receiving, by an audio processing system in an artificial reality system having a first microphone and a second microphone, audio samples collected by a first microphone;

processing, by the audio processing system, the audio samples collected by the first microphone using a first pipeline, wherein the first pipeline starts periodically at each of a plurality of starting clock cycles;

processing, by the audio processing system, audio samples collected by the second microphone using a second pipeline;

detecting, by the audio processing system, a transition by the second microphone from a disabled state to an enabled state;

performing, by the audio processing system and in response to detecting the transition, phase alignment between the audio samples collected by the first microphone and the audio samples collected by the second microphone; and processing, by the audio processing system, the aligned audio samples.

14. The method of claim 13, wherein performing phase alignment includes:

starting the second pipeline during each of the plurality of starting clock cycles.

15. The method of claim 14, wherein starting the second pipeline during each of the plurality of starting clock cycles includes:

introducing a delay in starting the second pipeline after detecting the transition by the second microphone from the disabled state to the enabled state, wherein the delay is calculated based on the length of the first pipeline and an amount of time until one of the starting clock cycles.

16. The method of claim 15, wherein the first pipeline operates at a first sampling frequency, wherein the second pipeline operates at a second sampling frequency that is different than the first sampling frequency, and wherein introducing the delay in starting the second pipeline includes:

calculating the delay further based on the difference between the first sampling frequency and the second sampling frequency.

17. The method of claim 16, wherein the second sampling frequency is higher than the first sampling frequency.

18. The method of claim 14, wherein starting the second pipeline during each of the plurality of starting clock cycles includes:

detecting a synchronization signal associated with the plurality of starting clock cycles; and upon detecting the synchronization signal, starting the second pipeline.

19. A non-transitory computer-readable storage medium comprising instructions that, when executed, configure an audio processing system of an artificial reality system to perform operations comprising:

receiving audio samples collected by a first microphone;

detecting a transition by a second microphone from a disabled state to an enabled state;

performing, by the audio processing system and responsive to detecting the transition, phase alignment between the audio samples collected by the first microphone and audio samples collected by the second microphone; and performing, by the audio processing system, directional alignment using aligned audio samples.

* * * * *